United States Patent [19]

Kashio et al.

[11] Patent Number: 4,911,053

[45] Date of Patent: Mar. 27, 1990

[54] ELECTRONIC STRINGED INSTRUMENT HAVING A STRING TRIGGER SWITCH

[75] Inventors: Yukio Kashio, Tokyo; Shigeru Uchiyama, Sayama; Yoshiyuki Murata, Tokyo, all of Japan

[73] Assignee: Casio Computer, Tokyo, Japan

[21] Appl. No.: 69,612

[22] Filed: Jul. 1, 1987

[30] Foreign Application Priority Data

| | | | |
|---|---|---|---|
| Jul. 4, 1986 | [JP] | Japan | 61-102190[U] |
| Aug. 20, 1986 | [JP] | Japan | 61-125910[U] |
| Oct. 4, 1986 | [JP] | Japan | 61-152093[U] |

[51] Int. Cl.[4] ..... G10H 3/18

[52] U.S. Cl. ..... 84/725; 84/727; 84/DIG. 24

[58] Field of Search ..... 84/1.14–1.16, 84/DIG. 24, DIG. 12, DIG. 7, DIG. 30

[56] References Cited

U.S. PATENT DOCUMENTS

| | | | |
|---|---|---|---|
| 3,073,203 | 1/1963 | Evans | 84/1.16 |
| 3,731,022 | 5/1973 | Loftus | 200/61.49 |
| 4,171,475 | 10/1979 | Erickson | 84/DIG. 7 X |
| 4,336,734 | 6/1982 | Polson . | |
| 4,372,187 | 2/1983 | Berg | 84/1.16 |
| 4,658,690 | 4/1987 | Aitken et al. . | |
| 4,723,468 | 2/1988 | Takabayashi et al. . | |

FOREIGN PATENT DOCUMENTS 2014865 10/1978 Fed. Rep. of Germany ..... 84/1.15

*Primary Examiner*—Stanley J. Witkowski

*Attorney, Agent, or Firm*—Frishauf, Holtz, Goodman & Woodward

[57] ABSTRACT

A string member and a string trigger switch mechanism associated with the string member are arranged on an instrument main body. The string member is extended on the instrument main body at a given tension. When the string member is deviated against the tension upon a string displace operation and is then released from its state of tension, a string trigger switch starts a switching operation. While the string member is displaced from its state of rest, the string trigger switch does not start a switching operation. The string trigger switch outputs a tone generation start instruction signal based on the switching operation, and this signal causes a musical tone generating apparatus to start generation of a musical tone. When the string member is plucked while depressing a pitch designating section arranged on the instrument main body, a musical tone at a selectively designated pitch is generated. A plucking force or a plucking speed is detected by a touch response detecting section, and characteristics of a generated musical tone are controlled accordingly.

47 Claims, 23 Drawing Sheets

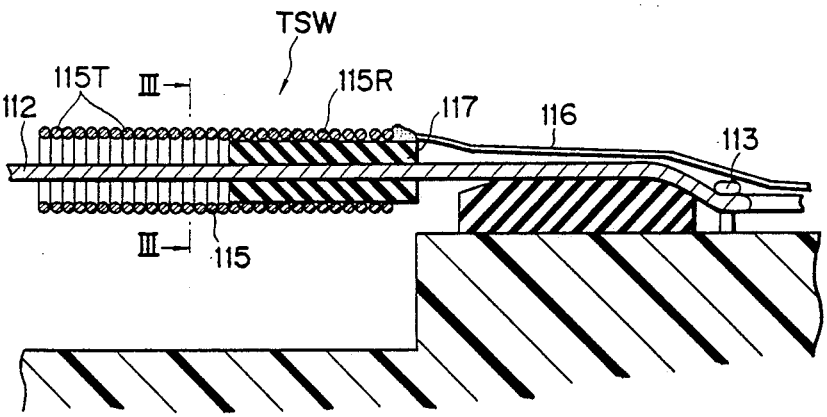
F I G. 2
F I G. 3
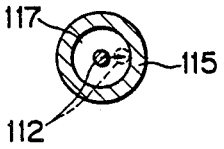
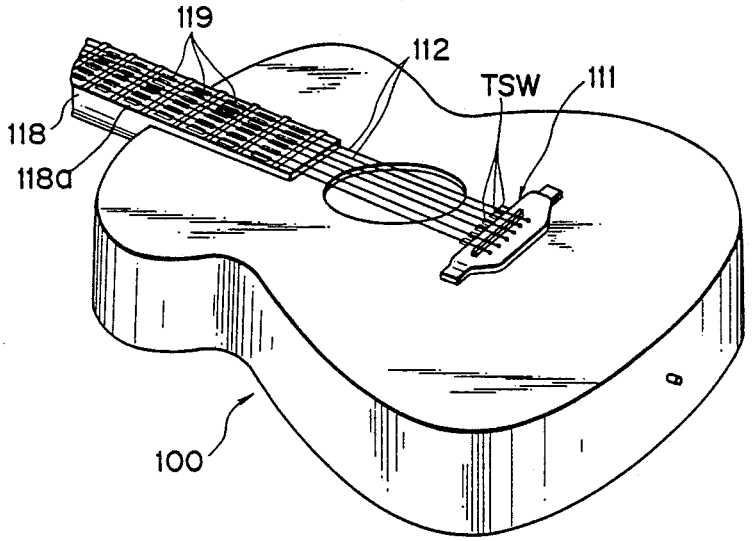
F I G. 4

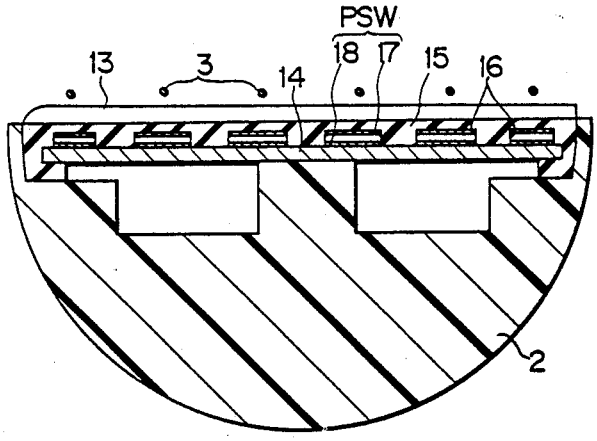
F I G. 21
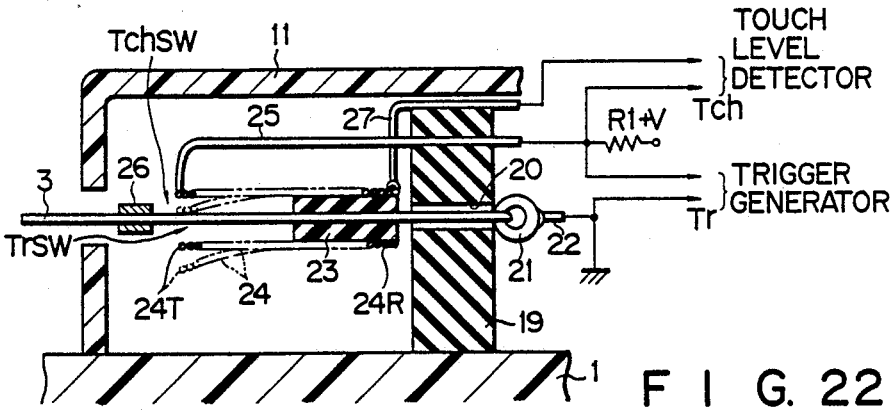
F I G. 22
F I G. 23
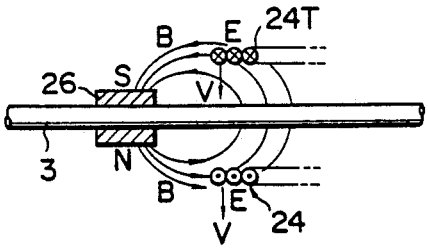

ELECTRONIC STRINGED INSTRUMENT HAVING A STRING TRIGGER SWITCH

BACKGROUND OF THE INVENTION

The present invention relates to an electronic stringed instrument and, more particularly, to an electronic stringed instrument which can be played by operations such as plucking, strumming, and the like, similar to those of a standard stringed instrument.

Electronic stringed instruments of this type as described in U.S. Pat. Nos. 4,336,734 and 4,658,690 are conventionally known. In the former electronic stringed instrument, a large number of touch-sensitive capacitive sensors for designating pitches of musical tones to be generated are embedded in a fingerboard formed on an instrument main body, and six strum bars capable of a plucking or strumming operation are stretched along a body formed on the instrument main body. In addition, string trigger switches each for initiating musical tone generation at a predetermined pitch designated by the corresponding sensor in cooperation with a corresponding strum bar are arranged at positions corresponding to the strum bars.

In this conventional electronic stringed instrument, a musical tone at a predetermined pitch designated by the sensor is produced as follows. The predetermined strum bar at a non-deviation position is depressed by a finger tip to be deviated toward a conductive member fixed to a bar support base side. When the strum bar is in electrical contact with the conductive member, the musical tone is produced. Therefore, when a player plays this electronic stringed instrument like a guitar play in practice, he experiences quite a different response from when he plays an acoustic stringed instrument (standard stringed instrument). More specifically, with the above stringed instrument, when the strum bar is depressed to be deviated and is in contact with the conductive member fixed to the bar support base, the desired musical tone begins to be produced. Therefore, in this electronic stringed instrument, a predetermined musical tone is not produced when the strum bar which has been deviated by a finger tip to a predetermined position is released. Thus, the player may often experience a slow response.

Traditional standard stringed instruments such as a koto in the East, or a harp, a guitar, and the like in the West have a mechanism in which surrounding air is vibrated by a vibration of a string to produce a predetermined musical tone. Upon analysis of a plucking operation of such a mechanism, it is found that the plucking operation comprises the first step wherein a string is deviated from its rest position (non-deviation state) to a predetermined position against its tension (in this step, the string merely accumulates predetermined energy to prepare for initiating vibration), and the second step wherein the string is released from the state (tense string state) wherein the string is deviated to the predetermined position. The string is vibrated mainly in the second step (string release step), thereby initiating production of a predetermined musical tone.

Therefore, when a standard stringed instrument is to be perfectly simulted by an electronic stringed instrument, it is important to simulate its playing operation, i.e., a tone generation start timing.

However, the tone generation start timing of the conventional electronic stringed instrument is considerably different from that of the traditional standard stringed instrument. For this reason, in order to obtain the same tone generation start timing as that of the standard stringed instrument, a high playing skill is required.

On the other hand, in the latter conventional electronic stringed instrument, six conductive strings supplied with a current and a pitch designating section consisting of a large number of touch sensors for sensing depressed string positions when the strings are depressed are arranged on a fingerboard formed on an instrument main body. In addition, trigger strings corresponding in number to the conductive strings and a string trigger detecting section for detecting vibration of these trigger strings are arranged on a body formed on the instrument main body.

However, in this conventional electronic stringed instrument, the string trigger detection section is constituted by a magnet arranged at the end portion of each trigger string, a housing for slidably storing the magnet, and a Hall effect sensor for detecting an axial movement of the magnet in the housing. In addition, an electronic control device is arranged. The control device outputs a tone trigger signal only when the trigger string is released from a tense state. The control device does not output a tone trigger signal while the trigger string is deviated from the non-deviation position to the predetermined position and, as a result, while the Hall effect sensor is axially moved in the housing. Therefore, the entire instrument becomes complicated. Since the string trigger detecting section is constituted by the Hall effect sensors, the instrument becomes expensive accordingly. In addition, since the Hall effect characteristics are easily changed over time, it is difficult to obtain a stable tone trigger signal over a long period of time.

SUMMARY OF THE INVENTION

It is a principal object of the present invention to provide an electronic stringed instrument in which a musical tone can be generated at the same timing as that of a traditional standard stringed instrument, and hence, which can be played in the same manner as the traditional standard stringed instrument.

It is another object of the present invention to provide an electronic stringed instrument which can embody the principal object with a simple and inexpensive mechanism.

It is still another object of the present invention to provide an electronic stringed instrument which can produce a musical tone at a predetermined pitch upon operation of a simple pitch designating section.

It is still another object of the present invention to provide an electronic stringed instrument in which various characteristics such as a tone volume, tone color, pitch, and the like of a musical tone can be changed in accordance with a string plucking force or plucking speed.

BRIEF DESCRIPTION OF THE DRAWINGS

FIG. 2 is a sectional view of a main part of a string trigger switch;

FIG. 3 is a sectional view taken along a line III—III in FIG. 2;

FIG. 4 is a partially cutaway perspective view showing a second embodiment of the present invention;

FIG. 21 is a sectional view taken along a line XXI—XXI in FIG. 20;

FIG. 22 is a sectional view showing a string trigger switch and a touch level switch used in the fourth embodiment;

FIG. 23 is a sectional view showing an electromotive force generation state of the touch level switch;

DETAILED DESCRIPTION OF THE PREFERRED EMBODIMENTS

An embodiment of the present invention will now be described with reference to the accompanying drawings. [First Embodiment (FIGS. 1 to 3)]

Figure 1:
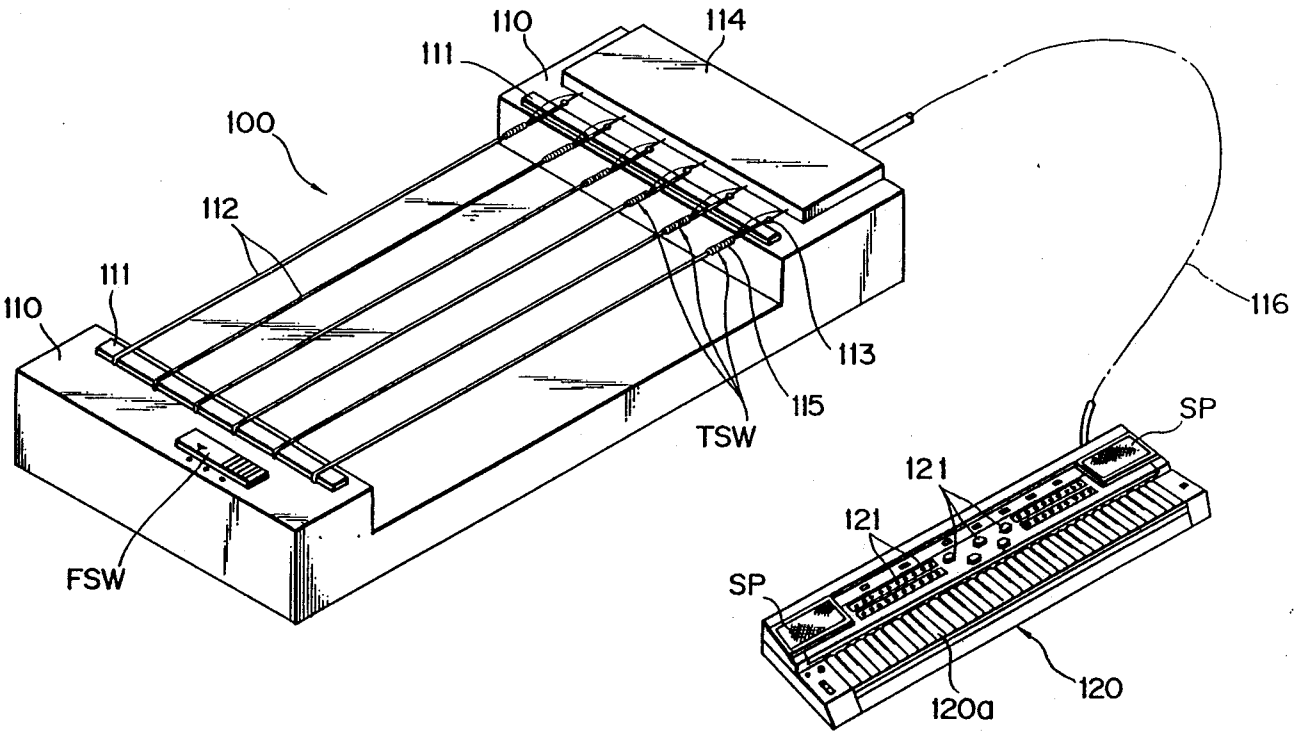
FIG. 1 is a perspective view showing a first embodiment of the present invention.

FIG. 1 shows the outer appearance of an electronic stringed instrument according to a first embodiment of the present invention, FIG. 2 shows a main part of a string trigger switch section, and FIG. 3 is a sectional view taken along a line III—III in FIG. 2.

Musical tone generating apparatus 120 which is reduced in size as illustrated with respect to instrument main body 100 has various functions of a keyboard type electronic musical instrument, and comprises keyboard 120*a*, various control switches 121 arranged on an operation panel, loudspeaker SP, and the like. Apparatus 120 incorporates a musical tone generation circuit, e.g., a CPU.

Main body 100 is connectable to apparatus 120 through connecting cable 116, and has a Zither-like appearance. Bases 100 are formed at the two end portions of main body 100, and at least one conductive string member 112 is extended between bases 110 and supported by support members 111 formed on bases 110. One end of each string member 112 is fixed to screw 113 capable adjusting a tension of a string. Terminal box 114 is also formed on base 110 on the side of screws 113. Respective wires of connecting cable 116 are connected to string members 112 and coil springs 115 which constitute string trigger switches TSW (for triggering musical tones) of main body 100 through terminal box 114 (to be described later in detail). In this embodiment, tone color switch FSW is provided on one base 110 so that a tone color can be switched by main body 100 upon playing.

FIG. 2 shows string trigger switch TSW in detail. More specifically, insulating member 117 is axially arranged on each conductive string member 112, root portion 115R of coil spring 115 is supported around insulating member 117. Since coil spring 115 is supported by insulating member 117, string member 112 is coaxial with coil spring 115. Therefore, free end 115T of coil spring 115 can be separated from string member 112 at a predetermined distance in a normal state. However, when string member 112 is released after it is deviated from a non-deviation position to a predetermined position, coil spring 115 cannot follow the movement of string member 112. Therefore, string member 112 is brought into contact with free end 115T of coil spring 115, as shown in FIG. 3. When conductive string member 112 is in electrical contact with coil spring 115, a tone generation start instruction signal is input to tone generating apparatus 120 through cable 115, and a predetermined musical tone is generated from apparatus 120.

When a spring constant of coil spring 115, a distance between coil spring 115 and string member 112, a tension of string member 112, and the like are appropriately selected, a contact between the two can be limited to once per operation, thereby effectively preventing chattering.

From the above description, the operation of this embodiment can be easily understood. More specifically, when string member 112 is deviated by a finger and is then released, string member 112 immediately starts deviation movement in accordance with a return force to the non-deviation position. However, initially, coil spring 115 is not biased and is kept in position by an inertial force. As a result, string member 112 is asynchronously moved relative to coil spring 115, and free end 115T is brought into electrical contact with string member 112. Thus, upon contact, a tone generation start instruction signal is generated, and is supplied to apparatus 120 through connecting cable 115. In response to an edge trigger signal due to this contact, apparatus 120 executes predetermined tone generation processing, thereby immediately generating a predetermined musical tone.

Musical tone processing by apparatus 120 will be briefly exemplified below. Apparatus 120 key-scans the states of trigger switches TSW. When apparatus 120 fetches an edge trigger signal generated upon contact, it assigns a tone source corresponding to the switch, and instructs the assigned tone source to start tone generation. Tone sources can be assigned as needed. For example, different pitches can be assigned to individual switches SW for one type of a musical tone (e.g., a Zither), or various types of musical tones of percussions can be assigned to individual switches SW.

In any case, the assigned musical tone is sent to a sound system of apparatus 120, and is produced through loudspeaker SP.

According to this embodiment, when conductive string member 112 is plucked or strummed after it is deviated from the non-deviation position to the predetermined position, a musical tone is generated. Therefore, the tone generation start timing of the instrument of this embodiment coincides well with that of a traditional standard stringed instrument. Therefore, the instrument of this embodiment can be used with almost the same playing technique as that of the traditional standard stringed instrument. Therefore, a player does not feel uneasy. [Second Embodiment (FIG. 4)]

FIG. 4 shows a second embodiment of the present invention, and an instrument main body of this embodiment has an acoustic guitar-like appearance.

A main difference between the first and second embodiments is that predetermined pitch data can be input in correspondence with each string member 112. More specifically, buttons 119 for designating pitches are arranged in a matrix on fingerboard 118*a* formed on neck 118. As in a normal guitar play, a player plucks string members 112 with his right hand while depressing buttons 119 with his left hand, thereby turning on string trigger switches TSW. Thus, a tone trigger signal is generated at that timing, and a musical tone at a specific pitch designated by specific button 119 of the button group associated with ON switch TSW is produced.

In this case, in a tone generating apparatus, the states of string trigger switches TSW for triggering musical tones are scanned. When string trigger switch TSW whose switch state is changed upon plucking of string member 112 is detected, the button group belonging to the corresponding switch TSW is scanned. When depressed specific button 119 is detected, pitch data designated by corresponding button 119 is set, and tone generation processing is executed (if not detected, pitch data of an open string is set).

In the first and second embodiments, string members 112 become moist upon long performance, and this may induce corrosion of string members 112 or erroneous operation of string trigger switches TSW. As a countermeasure against this, the surface of each string member 112 can be coated with an insulating material. [Third Embodiment (FIGS. 5 to 10)]

Figure 5:
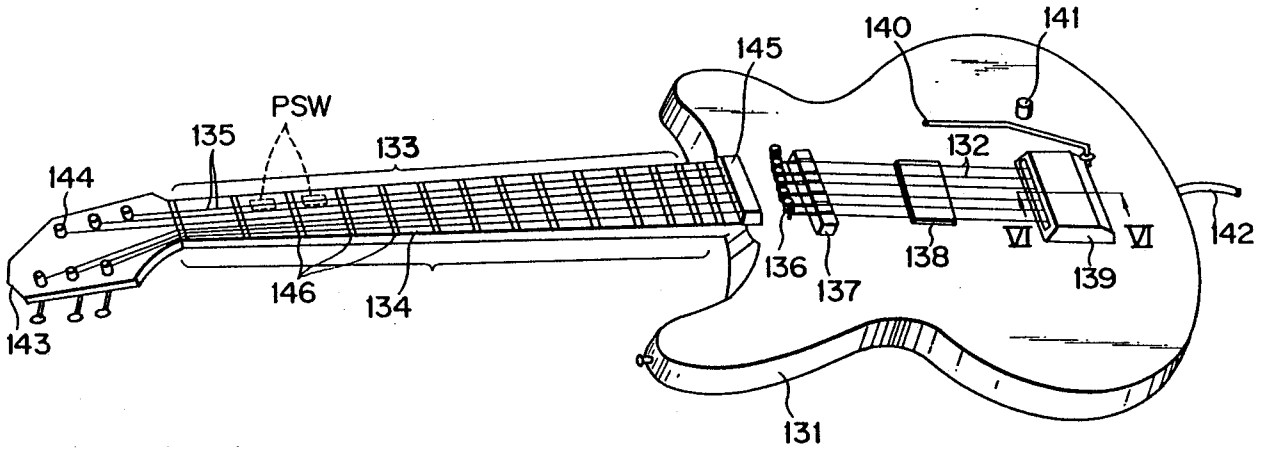
FIG. 5 is a perspective view showing a third embodiment of the present invention.

FIG. 5 is a perspective view of an entire electronic stringed instrument according to a third embodiment of the present invention. The electronic stringed instrument shown in FIG. 5 has a typical electric guitar appearance. A plurality of tone trigger strings 132 are extended on body 131, and similar strings (fret strings) 135 are extended on fingerboard 134 arranged on neck 133.

One end of each tone trigger string 132 is received by peg 136 and is guided along a groove formed in guide 137. The central portion of each string 132 is protected by protection plate 138 formed on the main body 131, and the other end thereof is fixed inside casing 139 incorporating string trigger switches TSW (to be described later). In addition, tremolo arm 140 for a tremolo play, and control switches such as tone volume control 141, and the like are arranged on body 131. Reference numeral 142 denotes a connecting cord connected to a musical tone generating apparatus.

One end of each fret string 135 is adjustably supported by peg 144 arranged on head 143, and the other end thereof is fixed inside bridge 145 formed on the base portion of neck 133. Frets 146 project at equal intervals on fingerboard 134. Pitch designating switch PSW (to be described later in detail) is arranged on each area sandwiched between adjacent frets 146 above which fret string 135 passes.

Figure 6:
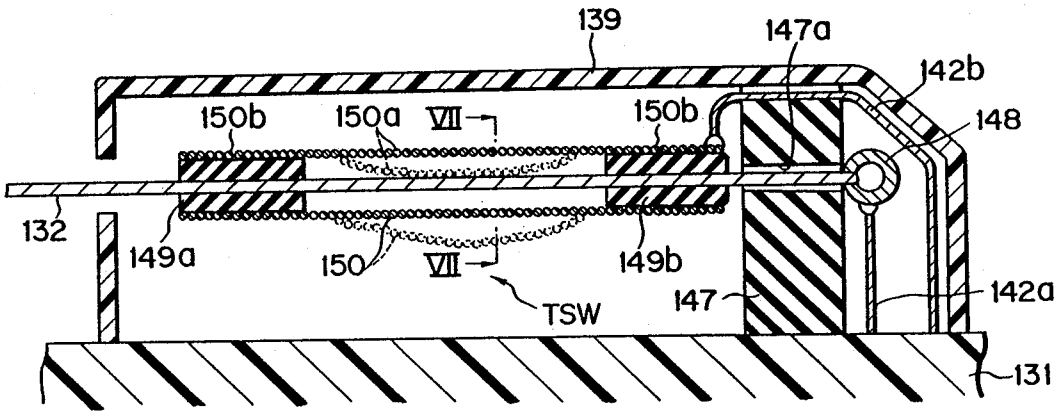
FIG. 6 is a sectional view taken along a line VI—VI in FIG. 5.
Figure 7:
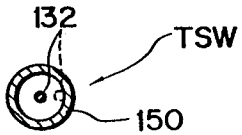
FIG. 7 is a sectional view taken along a line VII—VII in FIG. 6.

String trigger switch TSW will now be described with reference to FIGS. 6 and 7. As shown in FIGS. 6 and 7, one end of each conductive tone trigger string 132 extends through opening 147a formed in string holding portion 147 and is fixed to stop ring 148. First wiring 142a of connecting cord 142 is connected to stop ring 148. Therefore, trigger string 132 is used as one contact (first contact) of string trigger switch TSW.

A pair of insulating members $149_a$ and $149_b$ are fixed on the circumferential surface of trigger string 132 with a predetermined distance therebetween. Two ends $150_b$ of conductive coil spring 150 serving as the other contact (second contact) are fitted around insulating members $149_a$ and $149_b$, so that coil spring 150 is extended between members $149_a$ and $149_b$. Trigger string 132 is coaxial with coil spring 150, and hence, central portion $150_a$ between insulating members $149_a$ and $149_b$ maintains a predetermined gap from trigger string 132. However, when trigger string 132 is released after it is deviated, coil spring 150 cannot follow the vibration of trigger string 132, and a relative position between trigger string 132 and central portion $150_a$ of spring 150 is deviated as indicated by dotted lines in FIGS. 6 and 7. Thus, they are in electrical contact with each other.

End $150_b$ of spring 150 closer to string holding portion 147 is connected to second wiring 142*b* of connecting cord 142. Therefore, the contact of coil spring 150 serving as the second contact and trigger string 132 serving as the first contact is detected by CPU 155 in tone generating apparatus 120 shown in FIG. 10 as a tone generation start signal (tone trigger signal) for instructing triggering of a musical tone through connecting cord 142. The detected signal is supplied to tone generating circuit 156. In circuit 156, a tone signal is generated based on the tone generation start signal for triggering a musical tone and a pitch designating signal for designating a pitch (to be described later), and a corresponding musical tone is produced through D/A converter 157, amplifier 158, and loudspeaker 159.

Figure 8:
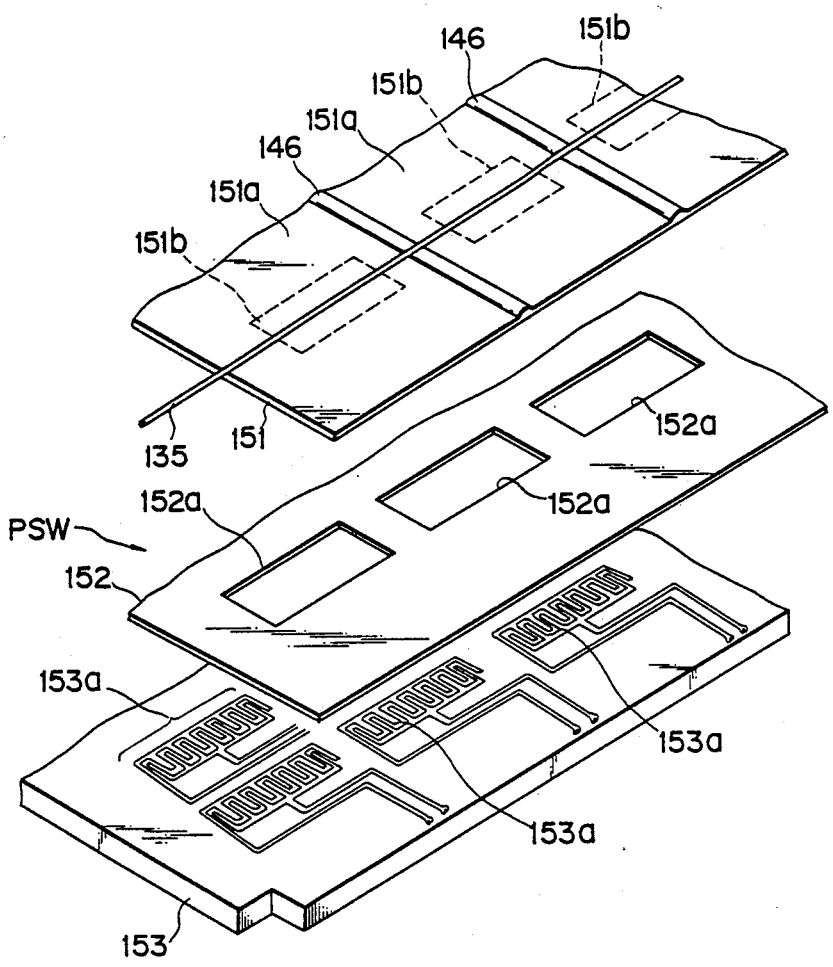
FIG. 8 is an exploded perspective view showing a pitch designating section.
Figure 9:
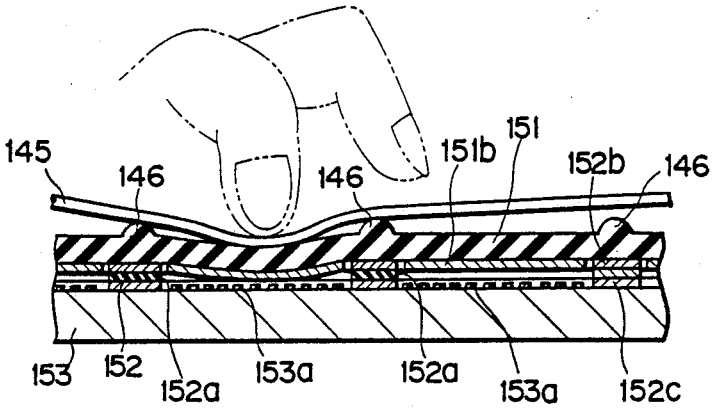
FIG. 9 is a sectional view of a state wherein the pitch designating section is depressed.
Figure 10:
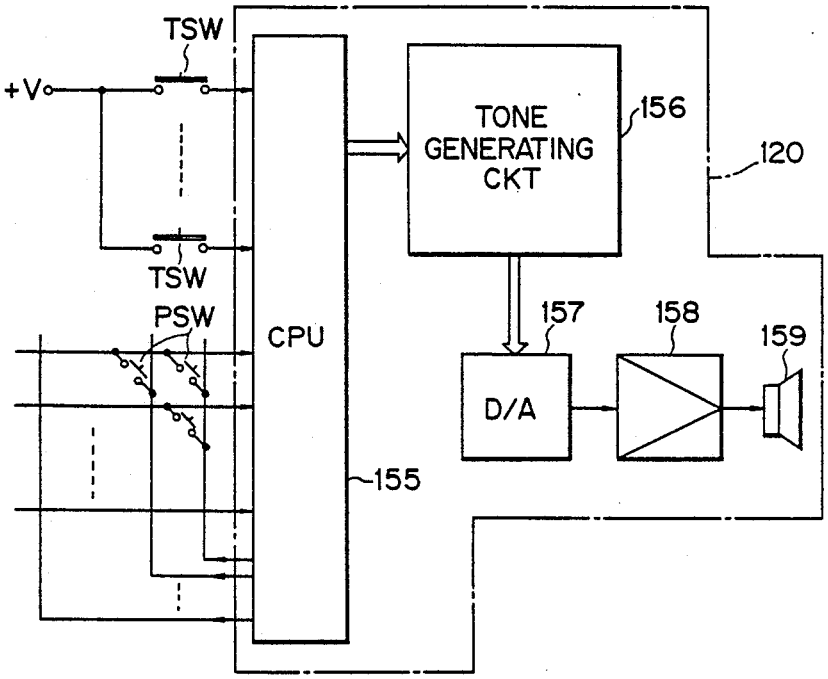
FIG. 10 is a general circuit diagram used in the third embodiment.

Pitch designating switch PSW will be described below with reference to FIGS. 8 and 9. As shown in FIGS. 8 and 9, fingerboard surface film 151, spacer 152, and circuit board 153 are laminated. Surface film 151 has a flexibility. Bridge electrode 151*b* for electrically connecting two interdigital electrodes 153*a* formed on circuit board 153 is formed on the rear surface of film 151 which corresponds to fret string 135 and is partitioned by adjacent frets 146. As shown in FIG. 9, when fret string 135 located between adjacent frets 146 is depressed by a finger, surface film 151 is deviated downward together with depressed fret string 135. Then, bridge electrode 151*b* on the rear surface is brought into contact with underlying interdigital electrodes 153*a* through opening 152*a* formed on spacer 152. As a result, electrodes 153*a* are electrically connected to each other through bridge electrode 151*b*. The electrical contact is signalled to tone generating apparatus 120 in the form of an electrical signal for designating a pitch. In this embodiment, interdigital electrodes 153*a* which can cover a wide-range switching operation are adopted as the tone pitch designating switches. Therefore, an area between adjacent frets 146 can be depressed at any position to electrically connect interdigital electrodes 153*a* by bridge electrode 151*b*. Therefore, the switching operation of pitch designating switches PSW can be reliably performed. Note that spacer segments 152*b* and 152*c* are formed on the front and rear surfaces of spacer 152 corresponding to each fret 146 so that each pitch designating switch PSW can be independently operated, and a gap between bridge electrode 151*b* and corresponding interdigital electrodes 153*a* can be maintained.

According to pitch designating switches PSW with the above structure, when fret string 135 between adjacent fret on fingerboard 134 is depressed by a finger, corresponding pitch designating switch PSW arranged in fret 146 is turned on, as shown in FIG. 9. The ON operation is detected by CPU 155 through connecting cord 142 as a pitch designating signal for designating a pitch, and the detected signal is supplied to tone generating circuit 156.

The operation of the third embodiment with the above structure is substantially the same as that of the first and second embodiments described above, and will be briefly described below.

Assume that one of trigger string 132 is plucked. Coil spring 150 of trigger switch TSW of the corresponding string 132 cannot follow a return movement of string 132 which is to be returned to a position before deviation, and its central portion $150_a$ is brought into contact with string 132, as shown in FIGS. 6 and 7. This contact is detected by CPU 155 as a tone generation start signal for instructing triggering of a musical tone. Upon reception of the tone trigger instruction from trigger switch TSW, CPU 155 scans the state of pitch designating switch PSW of fret string 135 corresponding to O switch TSW. In this case, for example, if third pitch designating switch PSW corresponding to third fret 146 is turned on, CPU 155 assigns a pitch designated by this switch PSW as a pitch associated with the above tone triggering operation, and performs tone generation processing.

When this input apparatus is connected to CPU 155 and tone generating circuit 156 having a polyphonic function, not only a melody play but also a chord play can be performed.

Fret strings 135 are adopted as guides for operating positions, and to provide natural playing feeling. However, if unnecessary, they can be omitted.

FIGS. 11 to 19 show different embodiments of string trigger switch TSW.

Figure 11:
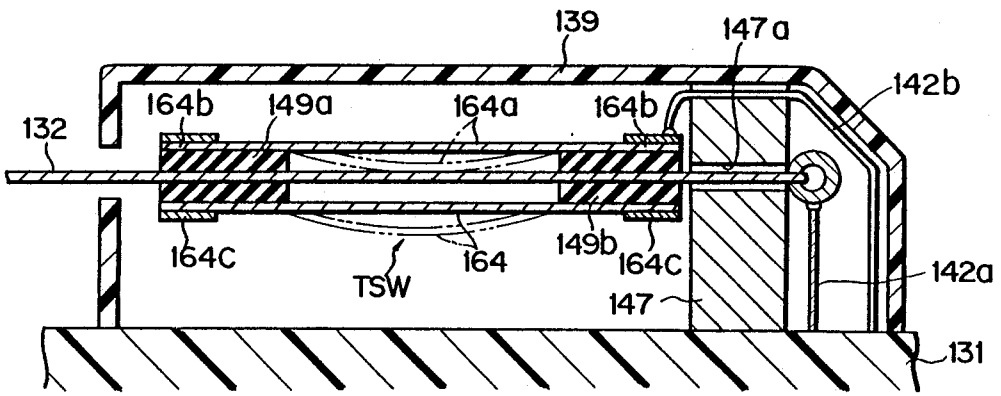
FIGS. 11, 12, and 13 are sectional views respectively showing different embodiments of a string trigger switch.

In the embodiment of string trigger switch TSW shown in FIG. 11, cylindrical conductive elastic tube 164 is used in place of coil spring 150 shown in FIG. 6. More specifically, cylindrical conductive fixing members 164C are adhered to the outer peripheries of two end portions 164*b* of conductive elastic tube 164 so as to reinforce a mounting state of tube 164 with respect to insulating member 149*a*. When such conductive elastic tube 164 is used, it has an advantage of durability superior to that of coil spring 150. More specifically, in the embodiment shown in FIG. 6, as a time of use of tone trigger string 132 is prolonged, the mechanical strength of coil spring 150 is degraded, and an accurate triggering operation cannot be maintained. Contrary to this, in this embodiment, since cylindrical conductive elastic tube 164 is used, it does not easily degrade or deform and has durability. Therefore, a service life can be prolongned.

Figure 12:
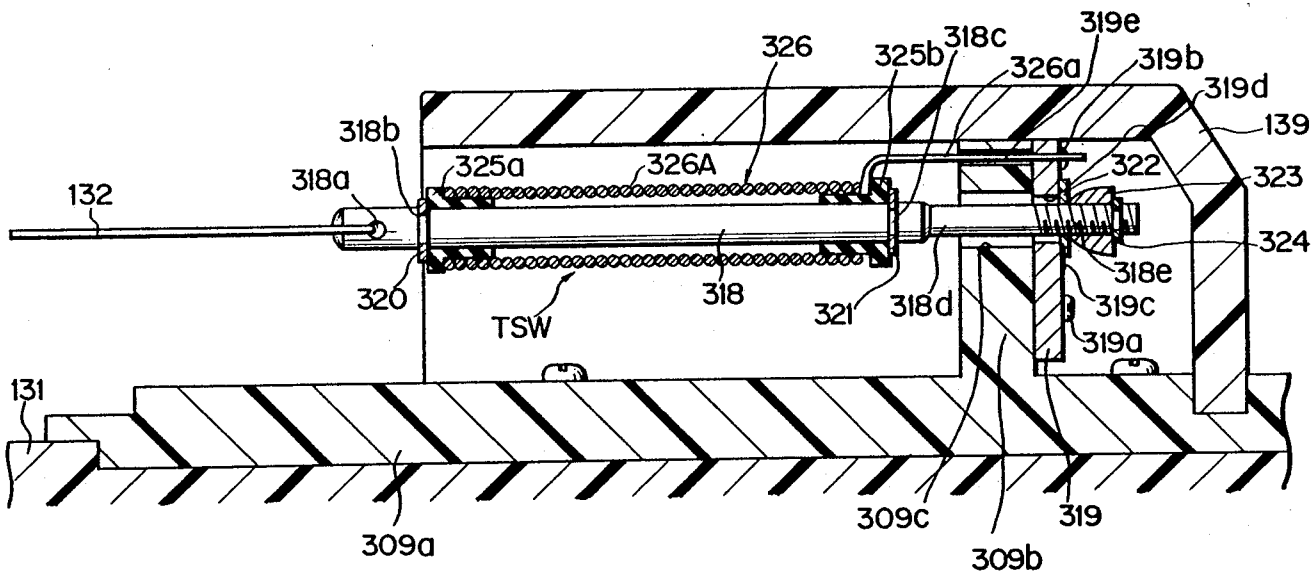

In an embodiment of string trigger switch TSW shown in FIG. 12, the following structure is adopted.

More specifically, as shown in FIG. 12, support portion 309*b* projecting from switching portion mounting base 309*a* mounted on body 131 supports a portion of conductive member 318 (to be described later). A plurality of through holes 309*c* which allow a plurality of conductive members 318 corresponding in number to strings 132 used to extend therethrough are formed on support portion 309*b*. Printed circuit board 319 is fixed to the right side surface of support portion 309*b* by stop screws 319*a*. Lead pattern 319*b* and common pattern 319*c* are printed on printed circuit board 319, and through holes 319*d* smaller than through holes 309*c* are formed on board 319 at positions corresponding to through holes 309*c* of support portion 309*b*. Common pattern 319*c* is arranged adjacent to through holes 319*d*, and lead pattern 319*b* is arranged above common pattern 319*c*. Lead wire through holes 319*e* are formed adjacent to lead pattern 319*b*, and also extend through support portion 309*b*.

Conductive member 318 is a round-rod metal member having a predetermined length. Engaging hole 318*a* engaged with corresponding string 132 is formed at the distal end portion of contactive member 318, and groove 318*b* engaged with first E-shaped stop ring 320 is formed behind engaging hole 318*a*. Groove 318*c* engaged with second E-shaped stop ring 321 is formed behind groove 318*b* to be separated a predetermined distance from groove 318*b*. Mounting portion 318*d* having a slightly smaller diameter is formed behind groove 318*b*. Mounting portion 318*d* is inserted through corresponding through hole 309*c* of support portion 309*b*, and male screw portion 318*e* is formed therebehind. Thus, contactive member 318 can be mounted on printed circuit board 319 through washer 322 by nut member 323 threadably engaged with male screw portion 318*e* and having a semi-spherical section. An annular groove formed at a position near a proximal end portion of male screw portion 318*e* engaged with nut member 323 receives third E-shaped stop ring 324, thereby preventing disengagement of nut member 323 from male screw portion 318*e*. Conductive member 318 is pivotally supported on support portion 309*b* due to a tension of each string 132. Since conductive member 318 is supported by a predetermined tension of string 132, washer 322 is urged against common pattern 319*c* of printed circuit board 319, and member 318 is connected to common pattern 319c.

A pair of insulating members $325_a$ and $325_b$ are symmetrically arranged between first and second E-shaped stop rings 320 and 321 of conductive member 318. Insulating members $325_a$ and $325_b$ comprise cylindrical members each having a projection on one end face, and are fixed to conductive member 318.

Conductive coil spring 326 as a conductive elastic member is extended between insulating members $325_a$ and $325_b$, and lead wire 326a extends from one end of coil spring 326. Lead wire 326a is connected to lead pattern 319b of printed circuit board 319 through lead wire through holes 319e respectively formed in support portion 309b and printed circuit board 319. In this manner, the two end portions of coil spring 326 are fitted and supported by insulating members $325_a$ and $325_b$. Therefore, conductive member 318 is coaxial with coil spring 326. Central portion 326A of coil spring 326 supported by insulating members $325_a$ and $325_b$ maintains a predetermined gap from the outer periphery of conductive member 318 in a normal state. However, when conductive member 318 is deviated due to vibration upon plucking of string 132, coil spring 326 is vibrated. As a result, the relative positions of conductive member 318 and coil spring 326 are deviated, thus causing an electrical contact therebetween. Then, a trigger signal for instructing triggering of a musical tone is generated, and is output to lead pattern 319b of printed circuit board 319 through lead wire 319b. The trigger signal is output to a musical tone generating apparatus through connecting cord 142. The trigger signal is detected by CPU 155 shown in FIG. 10, and a predetermined tone signal is generated from musical tone generating circuit 156 based on the trigger signal.

Figure 13:
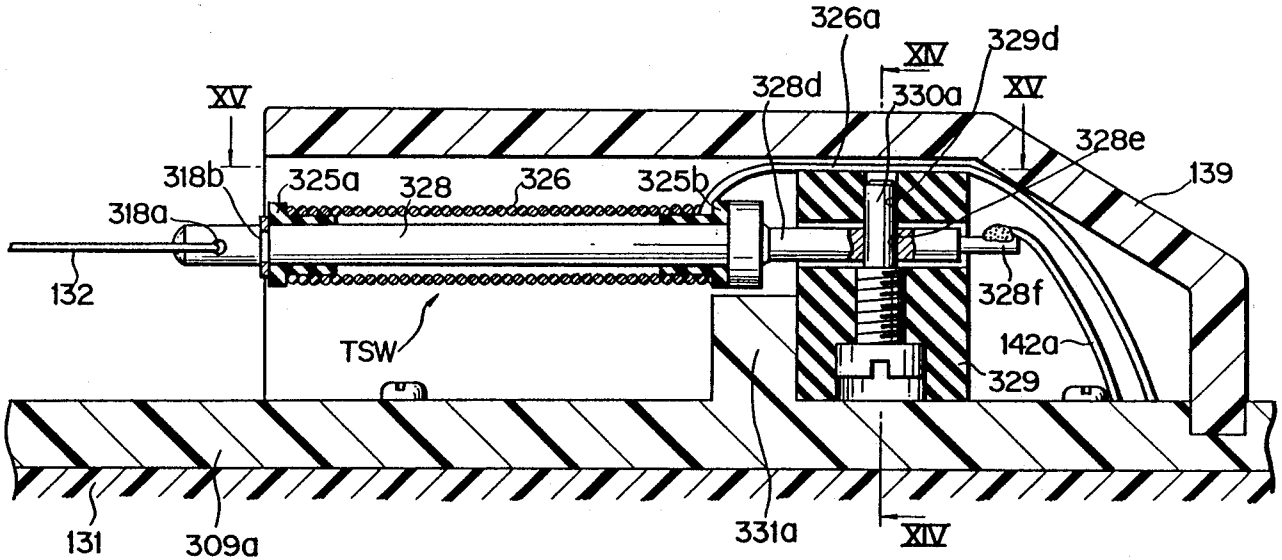
Figure 14:
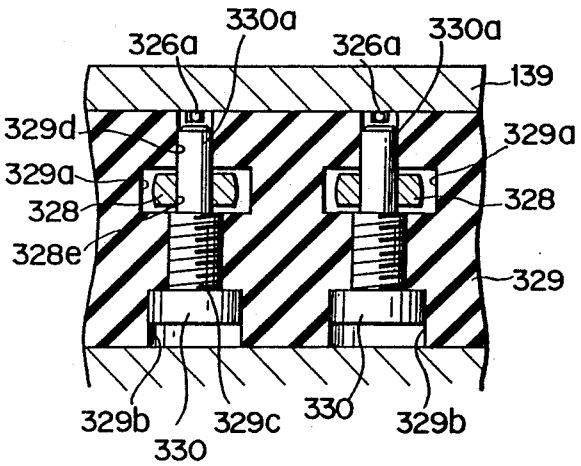
FIG. 14 is a sectional view taken along a line XIV—XIV in FIG. 13.
Figure 15:
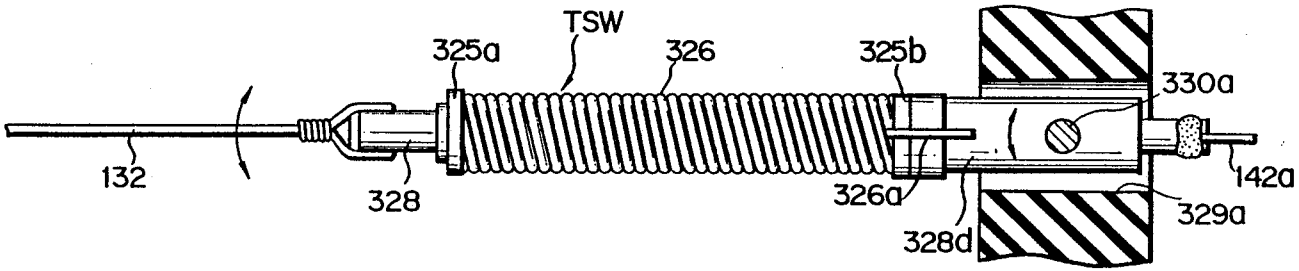
FIG. 15 is a sectional view taken along a line XV—XV in FIG. 13.

In an embodiment of string trigger switch TSW shown in FIGS. 13 to 15, a support mechanism of string trigger switch TSW is modified to be different from that in the embodiment shown in FIG. 12. Referring to FIGS. 13 to 15, flat mounting portion 328d is arranged behind conductive member 328. Through hole 328e is formed at the center of mounting portion 328d to extend through its flat thin portion. Terminal rod 328f integrally formed behind mounting portion 328d is connected to connecting cord 142a and is fixed thereto by soldering. Cord. 142a is connected to a musical tone generating apparatus (not shown).

Support base 329 for pivotally supporting conductive member 328 comprises a block member shown in FIG. 14, and through holes 329a each having a rectangular section are formed along its longitudinal direction at intervals coresponding to the arrangement intervals of strings 132. Counterbores 329b are formed at the center of each through hole 329a to extend from the lower surface side of support base 329. Female screw 329c reaching the bottom surface of through hole 329a is arranged in each counterbore 329b. Axial support hole 329d having the same diameter as that of through hole 328e formed in mounting portion 328d of conductive member 328 is formed on the side opposite to screw 329c and on the upper surface side of through hole 329a. Screw 330 having axial support shaft 330a inserted in axial support hole 329d is threadably engaged with each counterbore 329b of support base 329. Conductive member 328 is axially supported to be pivotal about axial support shaft 330a. With this structure, conductive member 328 is mounted on support base 329 to be pivotal in the right-and-left direction (see FIG. 12). Support base 329 is mounted behind stopper portion 331a (on the right side in FIG. 13) arranged at a predetermined position of switching mechanism mounting base 331 on body 131.

According to the string trigger switch TSW of this embodiment, conductive member 328 serving as a second contact can be vibrated about axial support shaft 330a in response to vibration of string 132 by a simple mechanism, and an electrical contact between member 328 and conductive coil spring 326 serving as a first contact can be provided upon this vibration.

Figure 16:
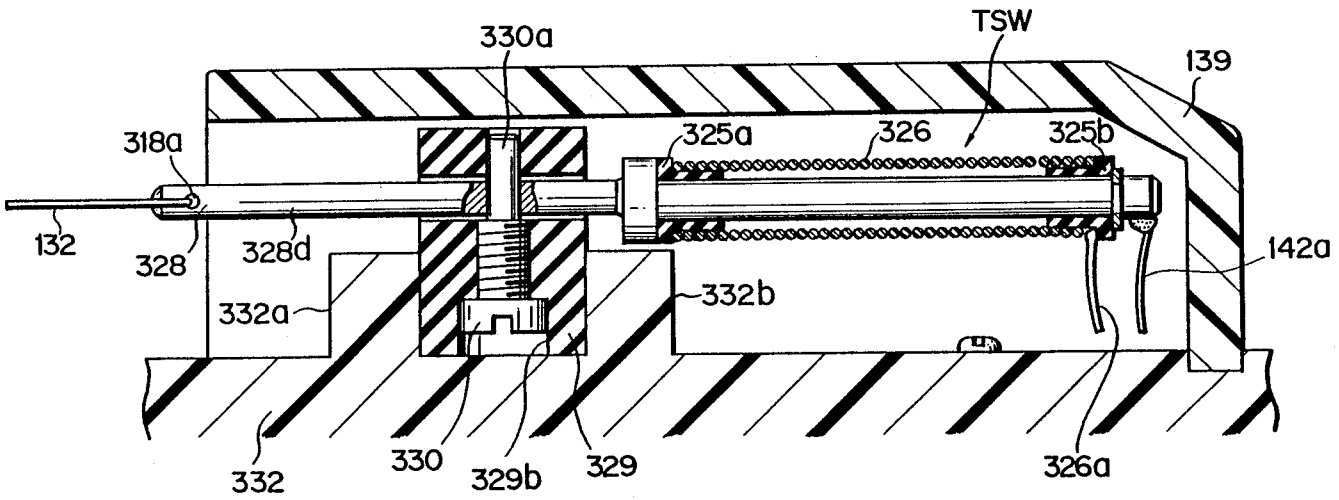
FIGS. 16, 17, 18 and 19 are sectional views respectively showing different embodiments of a string trigger switch.

In an embodiment of string trigger switch TSW shown in FIG. 16, mounting portion 328d of rod-like conductive member 328 is extended further behind from axial support shaft 330a, and conductive coil spring 326 is arranged on mounting portion 328d through a pair of insulating members $325_a$ and $325_b$, thus constituting string trigger switch TSW. Note that string support base 329 is clamped between a pair of stopper portions 332a and 332b provided to mounting base 332.

According to this embodiment, string trigger switch TSW is arranged at a side opposite to the tension side of string 132. Therefore, a wiring operation of connecting cord 142a and lead wire 326a can be facilitated. When string trigger switch TSW is to be repaired, repairs can be performed at a side opposite to the tension side of string 132, resulting in a quick and easy operation.

Figure 17:
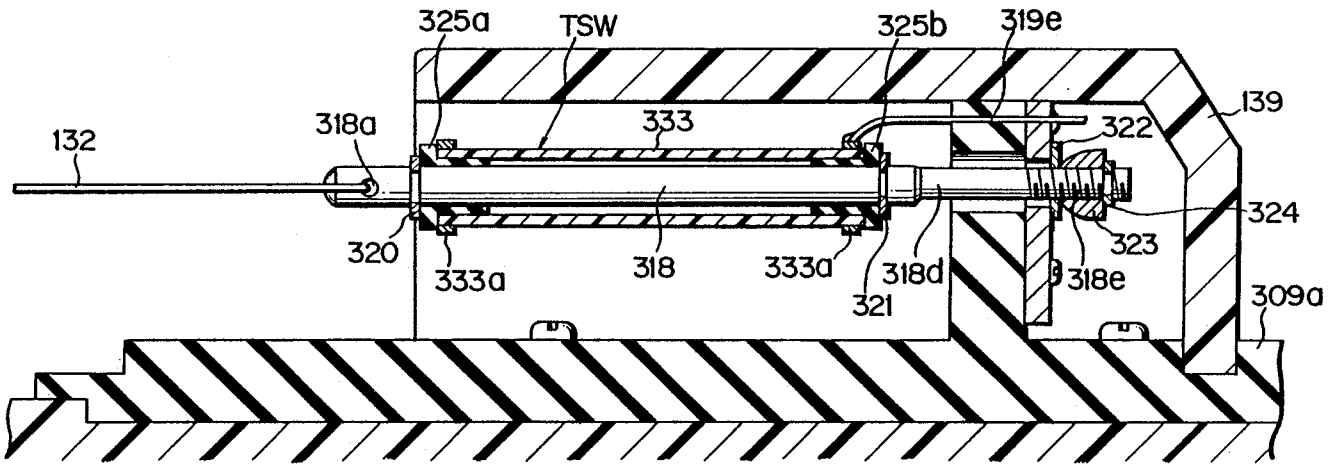

In an embodiment of string trigger switch TSW shown in FIG. 17, conductive elastic tube 333 is used in place of coil spring 326 as a conductive elastic member to constitute string trigger switch TSW. Cylindrical fixing members 333a are adhered to the outer periphery of conductive elastic tube 333 to reinforce the mounting state of tube 333 with respect to insulating members $325_a$ and $325_b$. When conductive elastic tube 333 is used as in this embodiment, a degradation of the central portion of tube 333 during use can be reliably prevented. Therefore, the central portion of tube 333 will not be undesirably in contact with the outer periphery of conductive member 318. Thus, an accurate trigger operation can be maintained. Conductive elastic tube 333 is not limited to this embodiment but can be applied to string trigger switches TSW in the previous embodiments.

Figure 18:
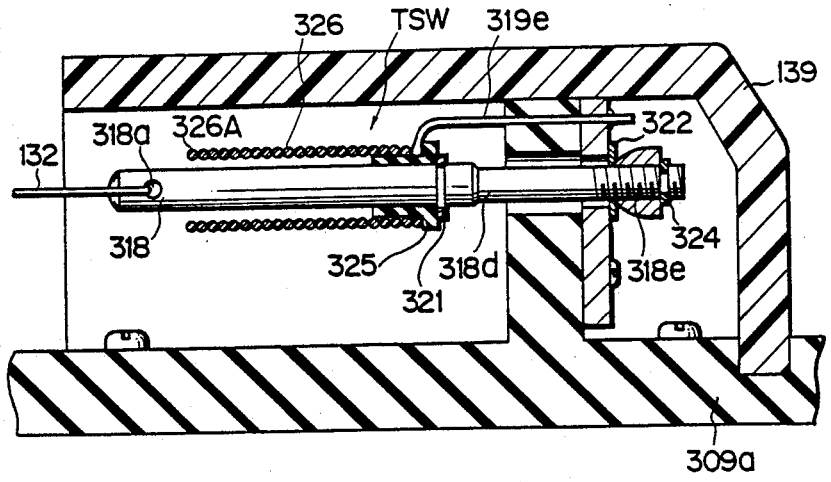

In an embodiment of string trigger switch TSW shown in FIG. 18, coil spring 326 as a conductive elastic member is supported by insulating member 325 in a cantilever manner. More specifically, in this embodiment, only one insulating member 325 is adhered to a position of second E-shaped stop ring 321, and coil spring 326 is fixed to the outer periphery of insulating member 325, thus constituting string trigger switch TSW. Free end 326A of coil spring 326 is arranged to be separated at a distance from the outer periphery of conductive member 318 in a normal state. When string 132 is plucked, free end 326A of coil spring 326 is in electrical contact with conductive member 318 upon vibration of string 132, thereby generating a tone trigger signal.

Figure 19:
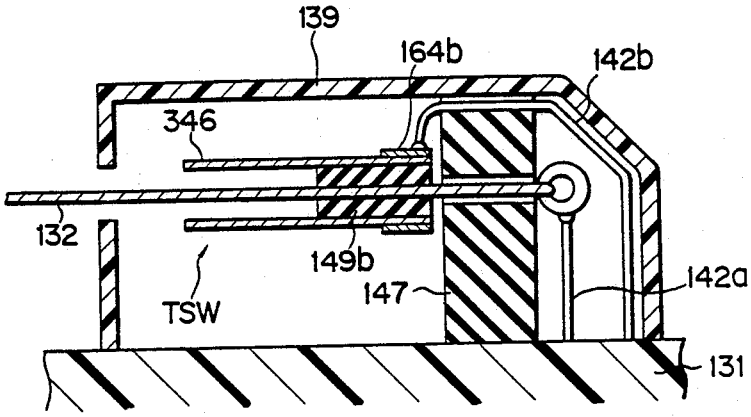

The above-mentioned structure of coil spring 326 with one free end can be applied to string trigger switches TSW in the above embodiments. In addition, if conductive elastic tube 346 with one free end is used in place of coil spring 326 to constitute string trigger switch TSW, as shown in FIG. 19, the same effect as described above can be obtained. [Fourth Embodiment (FIGS. 20 to 26)]

Overall Outer Appearance

Figure 20:
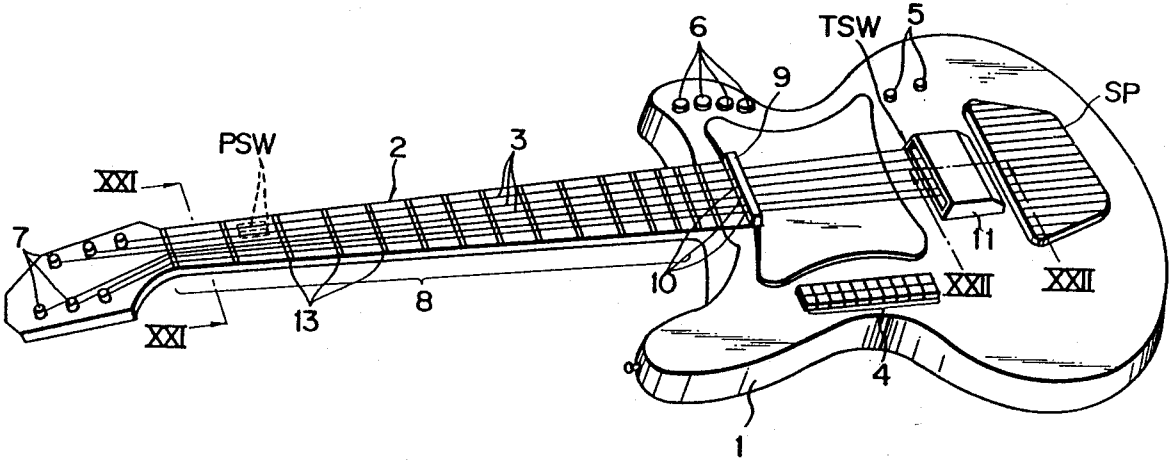
FIG. 20 is a perspective view showing a fourth embodiment of the present invention.

FIG. 20 is a perspective view showing an entire electronic stringed instrument according to a fourth embodiment of the present invention. A stringed instrument main body comprises body 1 and neck 2, and a plurality of strings 3 for playing a stringed instrument are extended along the longitudinal direction thereof. Pattern selection switch group 4 for selecting a tone color or a rhythm pattern are disposed on the lower left portion of body 1, and tempo/volume controls 5 for selectively designating a tempo or a tone volume are arranged on the upper right portion of body 1. Rhythm pad switch group 6 as operating members for a manual rhythm play is arranged on the upper left portion of body 1. Note that SP denotes a loudspeaker for producing a played musical tone.

More specifically, one end of each string 3 is supported on pin 7 on the upper portion of neck 2. Each string 3 is extended along fingerboard 8, and extends through guide hole 10, formed in guide 9, for suppressing vibration. The other end of each string 3 is fixed to a stop ring inside casing 11 for storing string trigger switches TSW arranged on the right portion of body 1. Pitch designating switches PSW are arranged in a matrix at positions of frets 13 on fingerboard 8. When string 3 between adjacent frets 13 is depressed, corresponding pitch designating switch PSW is turned on.

String trigger switches TrSW and touch level switches TchSW are housed in casing 11. When a portion of string 3 between guide 9 and casing 11 is plucked or strummed, corresponding string trigger switch TrSw and touch level switch TchSW are turned on. Thus, a corresponding musical tone is triggered, and a string plucking speed is detected.

Structure of Pitch Designating Switches PSW

FIG. 21 shows a sectional structure of pitch designating switches PSW. A large number of pitch designating switches PSW consisting of printed circuit board 14 and surface rubber 15 are fitted in recess portions formed on the upper surface of neck 2. Two edges of surface rubber 15 are bent in a U shape so as to cover and fix the two edges of printed circuit board 14. Six arrays of contact recess portions 16 are formed in the lower surface of surface rubber 15 bonded to printed circuit board 14 at positions between adjacent frets 13 and corresponding to each string 3. Movable contact 17 is patterned on the upper bottom surface of each contact recess portion 16, and stationary contact 18 is patterned on the upper surface of printed circuit board 14 facing recess portion 16. When a surface rubber 15 is depressed downward together with string 3, movable contact 17 is brought in to electrical contact with stationary contact 18, thereby designating a pitch.

Structure of String Trigger Switches TrSW

FIG. 22 shows a sectional structure of string trigger switches TSW. One end of each conductive string 3 is fixed to stop ring 21 via corresponding through hole 20 formed in string holding portion 19. Stop ring 21 is grounded through conductive wire 22. Columnar insulating member 23 is fixed to each string 3, so that string 3 extends through its central portion. Root portion 24R of conductive coil spring 24 having an inductance component is supported around insulating member 23. String 3 is coaxial with coil spring 24. Therefore, free end 24T of coil spring 24 maintains a predetermined gap from string 3 in a normal state. However, when string 3 is deviated from its state of rest and is then released from the deviating position, coil spring 24 cannot follow the movement of string 3, and free end 24T of coil spring 24 is brought into contact with string 3, as shown in FIG. 22. Root portion 24R of coil spring 24 is connected to constant power source $+V=5$ V through resistor R1. Therefore, when free end 24T of coil spring 24 is brought into contact with string 3 upon plucking of string 3, coil spring 24 and conductive wire 25 which are at high level by constant power source $+V$ go to low level. Thus, the low-level potential is output as musical tone trigger signal Tr through trigger generator 28 (to be described later).

Structure of Touch Level Switch TchSW

FIGS. 22 and 23 show the structure of touch level switch TchSW. Permanent magnet 26 is fixed to string 3 in front of free end 24T of coil spring 24. The upper portion of permanent magnet 26 is magnetized in an S pole and the lower portion thereof is magnetized in an N pole, as shown in FIG. 23. Therefore, the magnetic poles of magnet 26 are directed in the vertical direction. A magnetic flux from the N pole flows toward root portion 24R in the lower portion of coil spring 24, and flows substantially toward free end 24T in the upper portion of coil spring 24 and reaches the S pole. When coil spring 24 is deviated with respect to string 3, an induction electromotive force of $E=v\times B$ (v: a deviating speed of coil spring 24, B: a magnetic flux density) is generated in coil spring 24 due to the Fleming's right-hand rule. The electromotive force is output as touch response signal Tch indicating a level of string plucking speed via conductive wire 25 extending from free end 24T of coil spring 24 and via conductive wire 27 extending from root portion 24R of coil spring 24 and through touch level detector 29 (to be described later).

Note that permanent magnet 26 can be directed in the horizontal direction or two magnets 26 directed in vertical and horizontal directions, respectively, can be arranged.

Overall Circuit Arrangement

Figure 24:
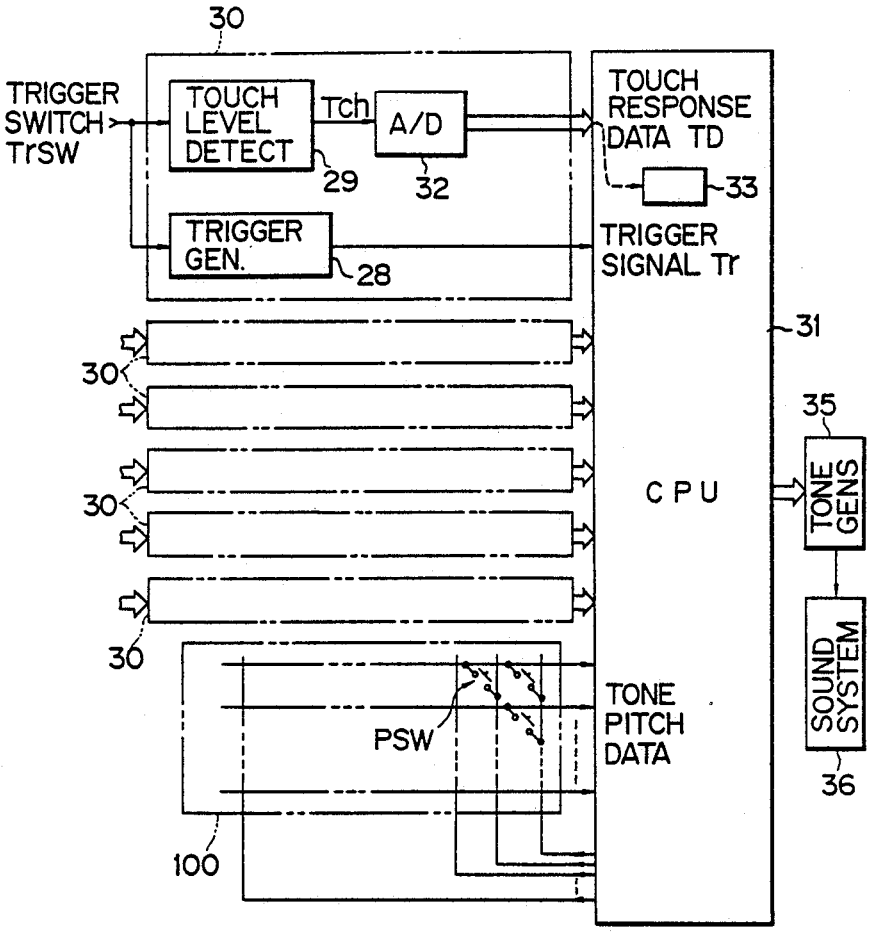
FIG. 24 is a general circuit diagram used in the fourth embodiment.

FIG. 24 shows the overall circuit arrangement. An ON signal from each string trigger switch TSW is supplied as musical tone trigger signal Tr to CPU 31 through inverter 28 constituting a trigger generator.

The ON signal from each string trigger switch TSW is also supplied to touch level detector 29 of play content detector 30. The above-mentioned coil spring 24 is incorporated in detector 29 as coil L, and a signal induced by coil L is output from detector 29 as touch response signal Tch indicating a string plucking force or a string plucking speed. Touch response signal Tch (analog signal) is converted into digital data by A/D converter 32, and the digital data is supplied to CPU 31. CPU 31 comprises peak value detecting memory 33 which compares the levels of immediately preceding digital data and current digital data to detect a peak level, and temporarily stores the peak level. The peak level of digital data first input to CPU 31 is supplied to memory 33 and is temporarily held therein. Upon a string plucking operation, tone trigger signal Tr from inverter 28 constituting the trigger generator is supplied to memory 33 as a signal for reading out touch response data TD stored therein.

Play content detector 30 is provided for each of six strings 3, so that touch response data TD and tone trigger signal Tr for each string 3 are supplied to CPU 31.

A large number of pitch designating switches PSW constituting pitch designating data detector 100 are arranged in 6 (corresponding to the number of strings 3) $\times$n (corresponding to the number of frets 13) matrix. Operated pitch designating switch PSW is detected by a scan signal from CPU 31, and data of the detected switch is supplied to CPU 31 as pitch data.

CPU 31 discriminates the input pitch data and touch response data TD each time tone trigger signal Tr is input, and supplies them to tone source circuit 35 to generate a musical tone signal having a frequency corresponding the pitch data and a tone volume corresponding to touch response data TD (can be a tone color or pitch). Then, a musical tone corresponding to the musical tone signal is produced from sound system 36.

Arrangement of Trigger Generator 28 and Touch Level Detector 29

Figure 25:
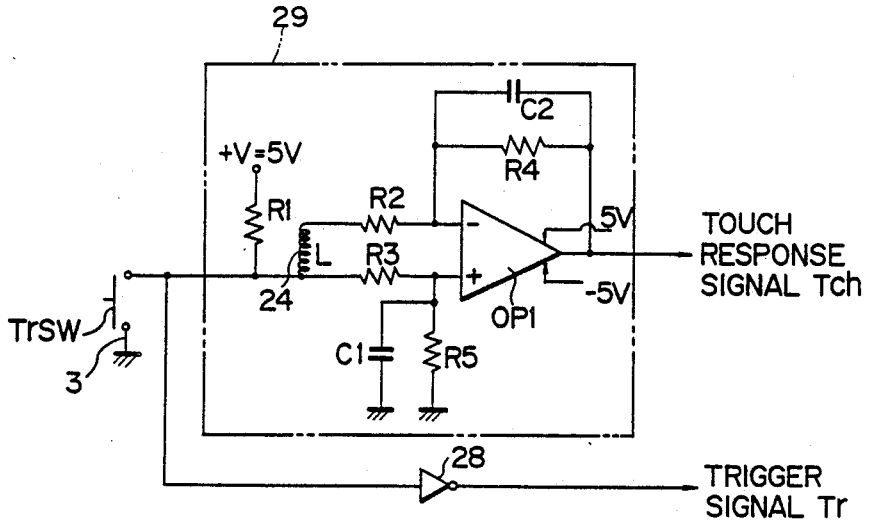
FIG. 25 is a circuit diagram showing a peripheral circuit of a touch level detector and a tone trigger generator.

FIG. 25 shows the detailed circuit arrangement of trigger generator 28 and touch level detector 29. Electromotive force E induced across coil spring 24 is supplied to the inverting and noninverting input terminals of operational amplifier OP1 through resistors R2 and R3. The noninverting input terminal is connected to a parallel circuit of resistor R5 and capacitor C1 one end of each of which is grounded, so as to prevent an irregular voltage at the input terminal of operational amplifier OP1. The output terminal of operational amplifier OP1 is fed back to the inverting input terminal thereof through a parallel circuit of resistor R4 and capacitor C2. As the input current at the inverting input terminal is increased, a charge current of capacitor C2 is increased, and the output voltage from operational amplifier OP1 is decreased, thereby performing an integrating operation. Note that resistors R4 and R5 have the same resistor characteristics, and capacitors C1 and C2 have the same capacitor characeristics.

Figure 26:
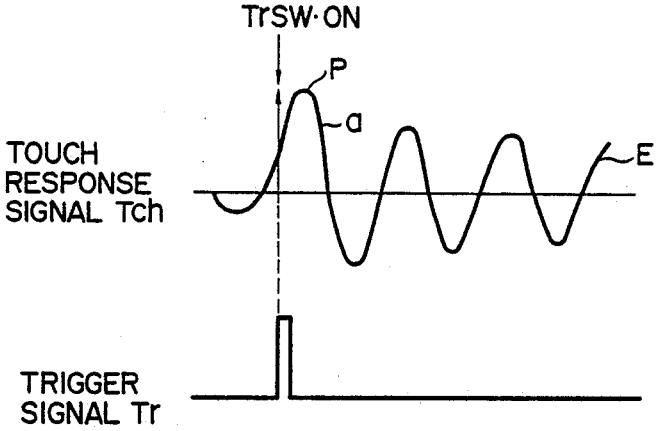
FIG. 26 is a timing chart of touch response signal Tch and tone trigger signal Tr.

Therefore, as shown in the upper portion of FIG. 26, when electromotive force E as indicated by solid curve a is induced at coil spring 24 upon a string plucking operation, operational amplifier OP1 outputs touch response signal Tch corresponding to solid curve a. First peak level P of touch response signal Tch is increased as a plucking force or plucking speed is larger and induced electromotive force E of coil spring 24 is larger.

One end of string trigger switch TrSW is grounded through string 3, and the other end thereof is connected to constant voltage source +V through coil spring 24 and resistor R1. The other end of trigger switch TSW is also connected to inverter 28 constituting the trigger generator. Therefore, when trigger switch TSW is turned on, the input potential level therefrom goes from 5 V to 0 V, and a high-level signal shown in the lower portion of FIG. 26 is generated as tone trigger signal Tr by the inverting operation of inverter 28. The peak value of touch response data TD which is generated after a predetermined period of time has passed from the generation timing of the high-level signal is output from peak level detecting memory 33.

[Operation]

Assume that any string 3 is plucked. Coil spring 24 of string trigger switch TSW corresponding to plucked string 3 cannot follow the movement of string 3, and magnetic flux B from permanent magnet 26 is cut at speed v by coil spring 24, thereby generating electromotive force $E=v\times B$. Electromotive force E is supplied to touch level detector 29 as touch response signal Tch. Signal Tch is converted into digital data by A/D converter 32, and its peak value is temporarily stored in peak level detecting memory 33. Upon plucking operation, free end 24T of coil spring 24 is brought into contact with string 3, and the peak value of touch response data TD temporarily held in memory 33 is supplied to tone source circuit 35 based on tone trigger signal Tr which is supplied from inverter 28 constituting the trigger generator to CPU 31.

The operating state of pitch designating switch PSW at this time is discriminated by CPU 31, and the peak value of touch response data TD is sent to conductive wire 25 together with the designated pitch data. Then, the musical tone signal is generated by tone source circuit 35 and the musical tone corresponding to the musical tone signal is produced from sound system 36.

In this case, if the plucking force against string 3 is large and the plucking speed is high, electromotive force $E=v\times B$ is increased, and the peak value of touch response data TD is also increased. As a result, a tone volume of the resultant musical tone (a change in tone color or pitch) is increased. If the plucking force against string 3 is small and the plucking speed is low, electromotive force $E=v\times B$ is decreased, and the peak value of touch response data TD is also decreased. As a result, a tone volume of the resultant musical tone (a change in tone color or pitch) is decreased.

In this manner, a tone volume, tone color, pitch, or the like can be finely changed in accordance with the plucking force or speed. If CPU 31 and tone source circuit 35 have a polyphonic function, not only a melody play but also a chord play can be performed.

In this embodiment, strings 3 are arranged above body 1 and neck 2. However, strings 3 above neck 2 are adopted for guides of operating positions, and to provide a natural play response. They can be omitted if unnecessary.

[Fifth embodiment (FIG. 27)]

Figure 27:
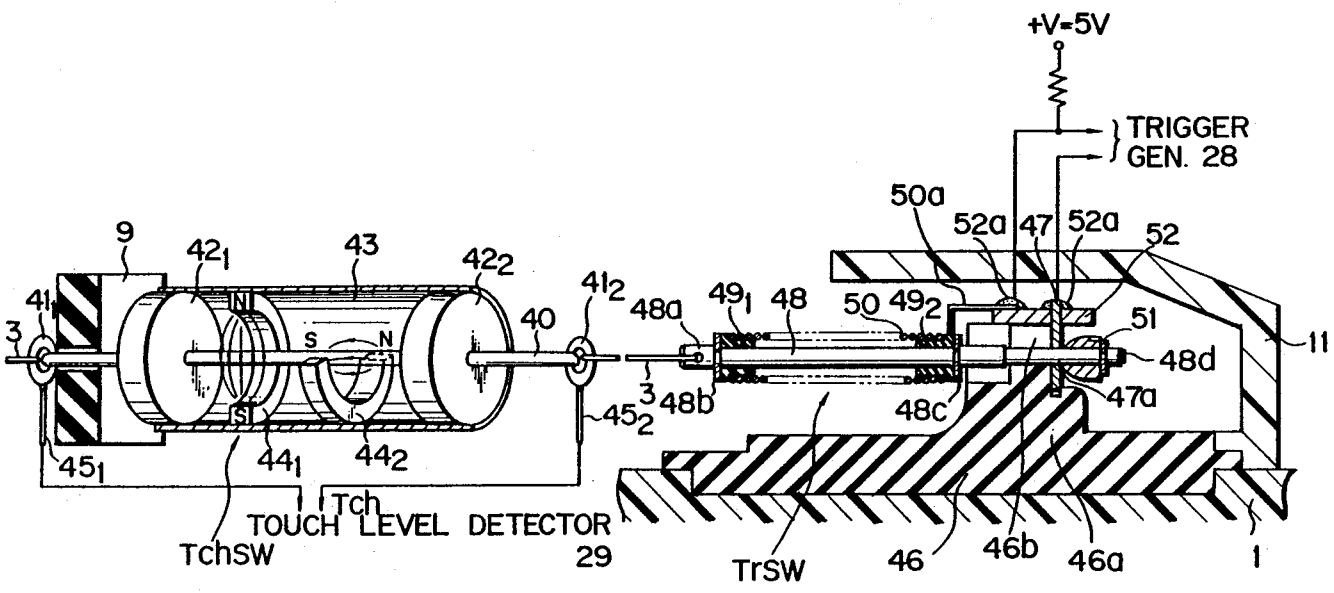
FIG. 27 is a longitudinal sectional view of touch level switch TchSW and string trigger switch TSW in a fifth embodiment.

FIG. 27 shows a fifth embodiment of the present invention. In this embodiment, touch level switch TchSW and string trigger switch TSW are arranged on identical string 3.

Structure of Touch Level Switch TchSW

In this embodiment, touch level switch TchSW is provided on one end of each string 3 (on the side of guide 9). Conductive response string 40 having an elasticity is inserted through guide hole 10 of guide 9. String 3 is attached to the two ends of response string 40 respectively through stop rings $41_1$ and $41_2$.

A pair of flat support members $42_1$ and $42_2$ are fixed to response string 40 to be separated at a predetermined distance, and response string 40 extends through their central portions. The two ends of flexible tube 43 are fitted on support members $42_1$ and $42_2$. Semi-annular permanent magnets $44_1$ and $44_2$ are mounted along the inner periphery of flexible tube 43. Two ends of each of permanent magnets $44_1$ and $44_2$ respectively serve as the N and S poles. The two ends of magnets $44_1$ and $44_2$ are respectively arranged to face vertically and horizontally, respectively. Therefore, the magnetic fluxes generated across the distal ends of permanent magnets $44_1$ and $44_2$ respectively flow in the vertical and horizontal directions.

Therefore, even if permanent magnets $44_1$ and $44_2$ are deviated in any direction, e.g., in the vertical, horizontal, oblique directions, and the like, electromotive force $E=v\times B$ (v: a deviating speed of permanent magnets 44, B: a magnetic flux density) is generated in response string 40 on the basis of the Fleming's right-hand rule. Electromotive force E is supplied to operational amplifier OP1 of touch level detector 29 through conductive wires $45_1$ and $45_2$ connected to stop rings $41_1$ and $41_2$ and through resistors R2 and R3. Then, force E is output as touch response signal Tch indicating the plucking speed.

Structure of String Trigger Switch TSW

String trigger switch TSW is provided on the other end of each string 3 (on the side of switch mounting base 46 formed on body 1). A projecting portion is formed on switch mounting base 46. Support portion 46*a* is formed on the upper surface of the projecting portion. A plurality of grooves 46*b* corresponding in number to strings 3 are formed on the upper portion of support portion 46*a* at equal intervals along the longitudinal direction of strings 3. Metal contact plate 47 is mounted on the rear edge of support portion 46*a* with grooves 46*b*. Through holes 47*a* are formed in contact plate 47 at positions on the extending lines of the tension directions of strings 3. Conductive members 48 are mounted on through holes 47*a* in correspondence with strings 3.

Each conductive member 48 is a round metal rod having a predetermined length. Engaging hole 48a engaged with corresponding string 3 is formed in the distal end portion of member 48. String 3 is engaged via engaging hole 48*a*. First and second stop rings 48*b* and 48*c* are arranged behind engaging hole 48*a* to be separated at a predetermined distance. A pair of cylindrical insulating members $49_1$ and $49_2$ are arranged on the outer periphery of conductive member 48 at symmetrical positions at which they are respectively in contact with first and second stop rings 48*b* and 48*c*. The two ends of conductive coil spring 50 are fitted on insulating members $49_1$ and $49_2$ to be extended therebetween.

Annular outwardly projecting portions are formed on the open end side of each of insulating members $49_1$ and $49_2$. The projecting portions electrically insulate coil spring 50 from stop rings 48*b* and 48*c* of conductive member 48. Support shaft 48*d* having a smaller diameter than other portions is formed behind second stop ring 48*c* of conductive member 48. The rear end of support shaft 48d extends through groove 46*b* of support portion 46*a* and through hole 47*a* of contact plate 47. The rear end of support shaft 48*d* is swingably locked by stopper 51 having a semi-spherical distal end portion around through hole 47*a* of contact plate 47. Therefore, the rear end of conductive member 48 is swingably locked by support shaft 48*d*, and the free end is extended and supported while being tensed by string 3.

The upper end portion of contact plate 47 for swingably supporting conductive members 48 is inserted in and fixed at a predetermined position of printed circuit board 52 arranged on support portion 46*a*, and is connected to a predetermined wiring pattern formed on printed circuit board 52 through solder 52*a*. Lead wire 50*a* extending from one end of coil spring 50 which is mounted on conductive member 48 through insulating members $49_1$ and $49_2$ is also connected to another wiring pattern on printed circuit board 52 through solder 52*a*. These wiring patterns are connected to trigger generator 28 through lead wires (not shown).

Therefore, when string 3 is plucked, coil spring 50 is vibrated upon deviation of coil spring 48. As a result, the relative positions of conductive member 48 and coil spring 50 are deviated, and they are brought into electrical contact with each other. Then, inverter 28 generates tone trigger signal Tr indicating the start of tone generation.

In this embodiment, magnetic fluxes B are generated in response string 40 by two permanent magnets $44_1$ and $44_2$ in the vertical and horizontal directions. Therefore, touch response data TD can be obtained even if string 3 is vibrated in vertical, horizontal, and oblique directions.

[Sixth Embodiment (FIG. 28)]

Figure 28:
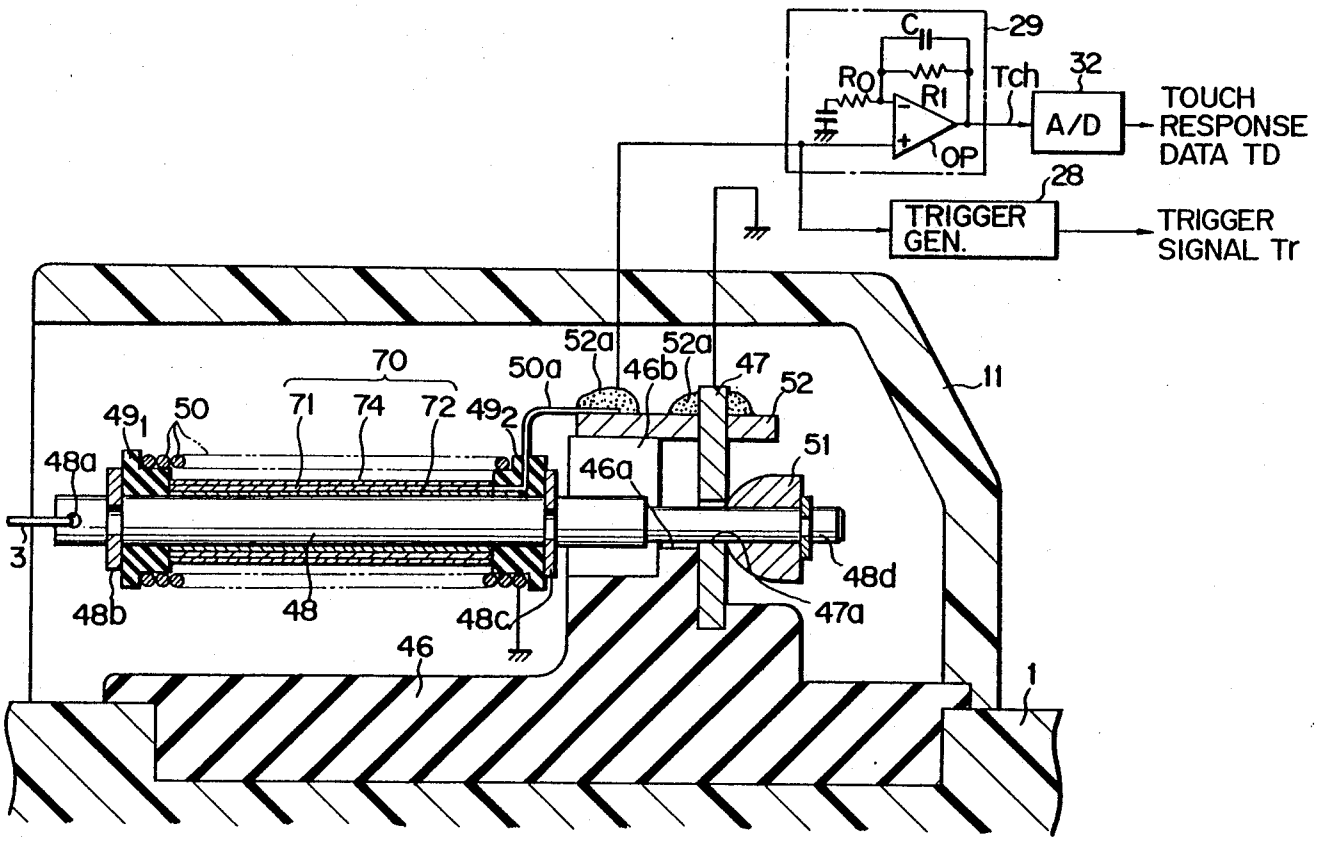
FIG. 28 is a longitudinal sectional view of touch level switch TchSW and string trigger switch TSW in a sixth embodiment.

FIG. 28 is a sectional view showing a main part of a sixth embodiment of the present invention. In this embodiment, cylindrical piezoelectric element 70 is integrally mounted on rod-like conductive member 48 one end of which is engaged with string 3 and the other end of which is swingably supported by support portion 46. Coil spring 50 is arranged to extend between a pair of annular insulating members $49_1$ and $49_2$ fixed to two end portions of piezoelectric element 70. Piezoelectric element 70 comprises piezoelectric film member 71 mounted on the outer periphery of conductive member 48, and electrode layer 72 formed on the outer periphery of piezoelectric film member 71. Shock protective layer 74 formed of an insulating material is integrally formed on the outer periphery of electrode layer 72. A method of fabricating piezoelectric film member 71 will be described later in a 10th embodiment. Lead wire 50*a* for supplying touch response signal Tch to touch level detector 29 consisting of resistor R1, capacitor C, and operational amplifier OP is extended from electrode layer 72. Note that touch response signal Tch also serves as tone trigger signal Tr. Other arrangements of this embodiment are the same as string trigger switch TSW in the fifth embodiment shown in FIG. 27. The same reference numerals in this embodiment denote the same parts as in the fifth embodiment, and a detailed description thereof will be omitted.

With the above structure, when string 3 is plucked to vibrate conductive member 48, the central portion of conductive coil spring 50 is flexed. Thus, the central portion strongly strikes the outer periphery of piezoelectric member 70 integrally mounted on the outer periphery of member 48 (strictly, shock protective layer 74 formed on the outer periphery of element 70). As a result, touch response signal Tch corresponding to the plucking force or plucking speed of string 3 is supplied to touch level detector 29 through conductive wire 50*a* extended from electrode layer 72 constituting element 70. Touch response signal Tch is output from detector 29 in accordance with the plucking force of string 3, and the touch response data TD is supplied to CPU 31. Touch response signal Tch also serves as tone trigger signal Tr. Since tone source circuit 35 is driven based on touch response data TD at a generation timing of tone trigger signal Tr, a musical tone signal can be generated with a tone volume and the like corresponding to touch response data TD.

In this embodiment, piezoelectric element 70 is formed around conductive member 48 coupled to string 3. Therefore, touch response data TD can be obtained even if string 3 is vibrated in any direction, e.g., the vertical, horizontal, and oblique directions. Since piezoelectric element 70 is commonly used by switches TSW and TchSW, the structure can be simplified.

[Seventh Embodiment (FIG. 29)]

Figure 29:
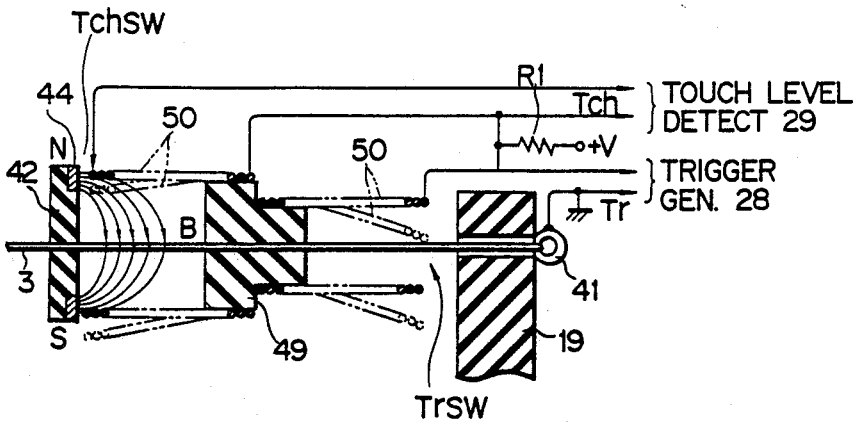
FIG. 29 is a longitudinal sectional view of touch level switch TchSW and string trigger switch TSW in a seventh embodiment.

FIG. 29 shows a seventh embodiment of the present invention. In this embodiment, disk-like support member 42 is fixed to each string 3 so that string 3 extends through its central portion. Semi-annular permanent magnet 44 is mounted on the periphery of the circular upper surface of support member 42. Columnar insulating member 49 is also fixed to each string 3 so that string 3 extends through its central portion. An outer diameter of a large-diameter portion of insulating member 49 is slightly smaller than the outer diameter of support member 42. The base portion of coil spring 50 for touch level switch TchSW is fixed around the large-diameter portion of insulating member 49. The free end of coil spring 50 closely faces permanent magnet 44 of support member 42.

Therefore, when coil spring 50 is deviated at speed v with respect to string 3, the distal end of coil spring 50 crosses magnetic flux B of permanent magnet 44, and electromotive force E is induced between the free end and base portion of coil spring 50. Electromotive force E is supplied to operational amplifier OP1 of touch level detector 29 through resistors R2 and R3, and is then output therefrom as touch response signal Tch indicating the plucking speed.

The base portion of another coil spring 50 for string trigger switch TSW is fixed around a small-diameter portion of insulating member 49. The free end of coil spring 50 is brought into contact with string 3 when string 3 is plucked, and causes trigger generator 28 to output tone trigger signal Tr.

In this embodiment, coil spring 50 for touch level switch TchSW and coil spring 50 for string trigger switch TSW are separately arranged. Therefore, the elasticity of coil spring 50 for obtaining the touch response signal and the elasticity of coil spring 50 for obtaining the tone trigger signal can be optimally selected.

Note that two permanent magnets 44 directed vertically and horizontally can be arranged as in the fifth embodiment shown in FIG. 27.

[Eighth Embodiment (FIG. 30)]

Figure 30:
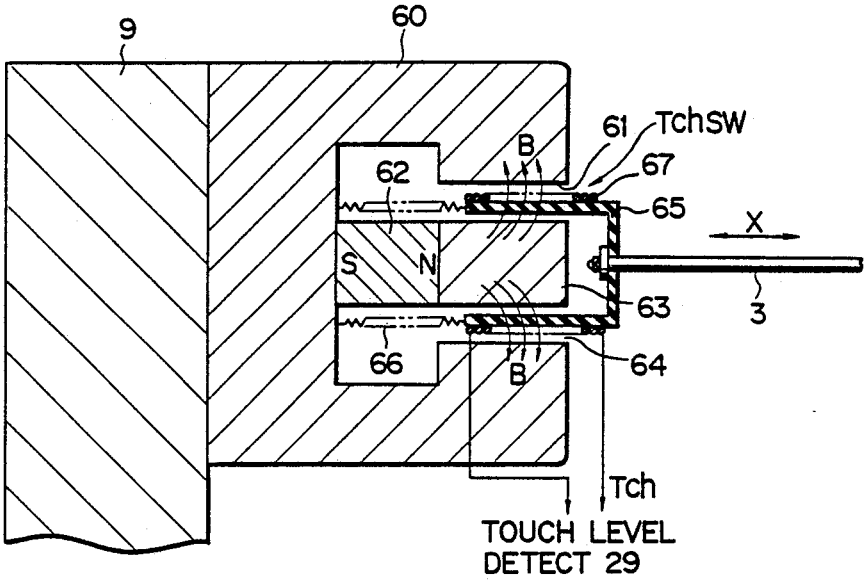
FIG. 30 is a longitudinal sectional view of touch level switch TchSW in an eighth embodiment.

FIG. 30 shows the structure of each touch level switch TchSW according to an eighth embodiment. Hollow box-like yoke 60 formed of a ferromagnetic material is mounted on the side surface of guide 9 arranged on body 1. Circular hole 61 is formed in the side surface of yoke 60. Permanent magnet 62 having a lower columnar portion and pole 63 having an upper columnar portion and formed of the same material as that of yoke 60 are inserted in circular hole 61. Gap 64 is formed between pole 63 and the wall surface of circular hole 61.

Cylindrical bobbin 65 having an upper bottom surface at one end is inserted in gap 64, and the other end of bobbin 65 is coupled to the inner bottom surface of yoke 60 by spring 66. The end portion of string 3 is coupled to the end face of the upper bottom surface of bobbin 65.

Response coil 67 is would around the outer periphery of cylindrical bobbin 65. Note that string trigger switch TSW (not shown) as in the fifth embodiment shown in FIG. 27 is integrally arranged on the other end of string 3. With this structure, when string 3 is vibrated upon plucking, string trigger switch TSW is turned on, and tone trigger signal Tr is generated. At the same time, string 3 is vibrated along its longitudinal direction (X direction in FIG. 30) against the biasing force of spring 66. Therefore, response coil 67 around bobbin 65 crosses magnetic flux B flowing from permanent magnet 62 to yoke 60 through pole 63, thereby generating an electromotive force across response coil 67. The electromotive force is supplied to operational amplifier OP1 of touch level detector 29 through resistors R2 and R3, and is then output as touch response signal Tch indicating the plucking speed.

In this embodiment, touch response data TD is obtained based on deviation of string 3 in the longitudinal direction. Therefore, touch response detection can be reliably performed even if string 3 is plucked in any direction, e.g., the vertical or horizontal direction.

[Ninth Embodiment (FIG. 31)]

Figure 31:
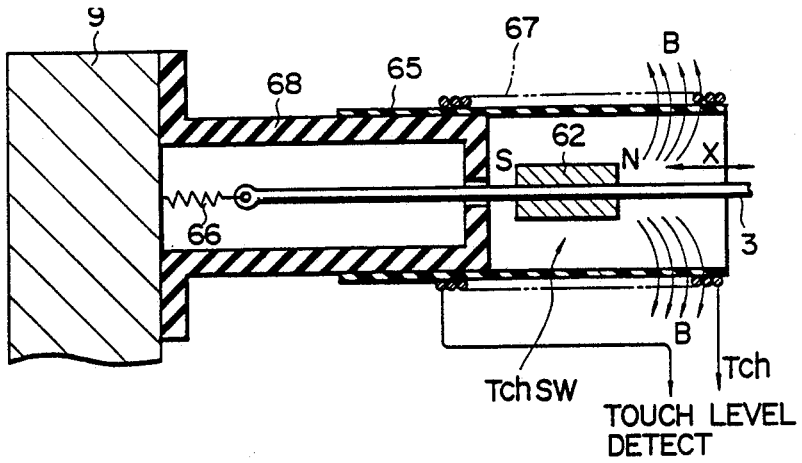
FIG. 31 is a longitudinal sectional view of touch level switch TchSW in a ninth embodiment.

FIG. 31 shows the structure of touch level switch TchSW according to a ninth embodiment of the present invention. The lower surface of cylindrical support column 68 whose lower edge extends outwardly is mounted on the side surface of guide 9. Cylindrical bobbin 65 is fitted on the outer periphery of the distal end of support column 68. Response coil 67 is wound around the outer periphery of bobbin 65. One end portion of string 3 extends through the upper bottom surface of support column 68, and is fixed to the side wall surface of guide 9 via spring 66. Cylindrical permanent magnet 62 is fixed to string 3 inside bobbin 65 so that string 3 extends through its central portion. The upper bottom surface of permanent magnet 62 serves as the N pole and the lower bottom surface thereof serves as the S pole. Note that in this embodiment, string trigger switch TSW (not shown) as in the fifth embodiment shown in FIG. 27 is also integrally arranged.

When string 3 is plucked to be vibrated, string trigger switch TSW is turned on, and tone trigger signal Tr is generated. At the same time, string 3 is vibrated in the longitudinal direction (direction indicated by arrow X in FIG. 31) against the biasing force of spring 66. Therefore, permanent magnet 62 is also vibrated in the longitudinal direction, and magnetic flux B crossing response coil 67 is moved in the longitudinal direction of response coil 67. Therefore, an electromotive force is generated across response coil 67, and is supplied to operational amplifier OP1 of touch level detector 29 through resistors R2 and R3. Then, the electromotive force is output as touch response signal Tch indicating the plucking speed.

In this embodiment, the same effect as in the seventh embodiment shown in FIG. 29 can be obtained. In addition, since only string 3 and permanent magnet 62 are movable, the structure can be simplified.

Permanent magnets 62, 26, and 44 in the ninth, fifth and seventh embodiments can be replaced with a structure wherein a coil is arranged integrally with string 3 and a current is flowed through string 3.

[Tenth Embodiment (FIGS. 32 and 33)]

Figure 32:
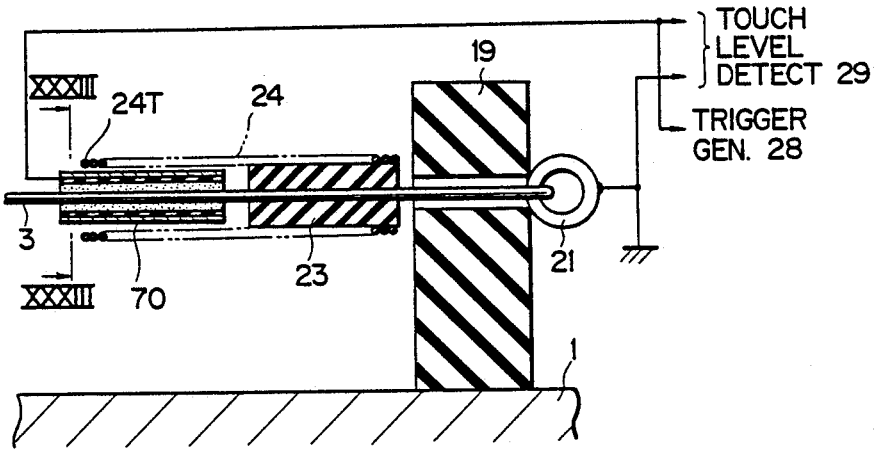
FIGS. 32 and 33 are respectively a longitudinal sectional view of touch level switch TchSW and string trigger switch TSW in a 10th embodiment and an enlarged sectional view taken along a line XXXIII—XXXIII in FIG. 32.
Figure 33:
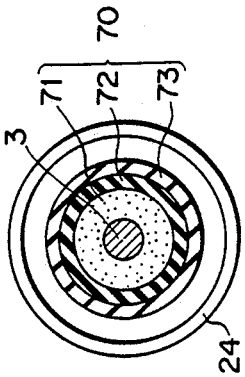

FIGS. 32 and 33 show the structure of string trigger switch TSW and touch level switch TchSW according to a tenth embodiment of the present invention. The structure of this embodiment resembles that in the fourth embodiment in FIG. 22. Columnar piezoelectric element 70 is fixed to string 3 inside free end 24T of coil spring 24 so that string 3 extends through the central portion of element 70. In this piezoelectric element 70, piezoelectric film member 71 is deposited around metal string 3 as shown in FIG. 33 to perform polarization. Electrode layer 72 is coated on piezoelectric film member 71, and insulating film 73 is coated on the outer surface of electrode layer 72.

In a method of preparing piezoelectric film member 71, 10% by weight of $PVF_2$ powder is added to 75% by weight of dimethylacetoamide, and the resultant mixture is heated and melted at a temperature of about 70° C. for 20 to 30 minutes. After the resultant mixture is gradually cooled, 15% by weight of acene is added and, the resultant warm solution mixture is coated on metal wire 1 and is baked at a temperature of 150° C. for 10 minutes and at 210° C. for 5 minutes. The coating and baking processes are repeated several times to obtain a predetermined film thickness. Thereafter, a conductive material is coated on the resultant film to form electrode layer. A voltage is applied across metal wire and electrode layer so as to obtain a metal wire surface field intensity of 5 kV/100 V, and a polarization treatment is performed at a polarization temperature of about 90° C.

Other arrangements are the same as those in the fourth embodiment. The same reference numerals in this embodiment denote the same parts as in the fourth embodiment, and a detailed description thereof will be omitted.

Since piezoelectric element 70 is used, a signal sent to trigger generator 28 and touch level detector 29 appears across one end corresponding to grounded string 3 and the other end corresponding to electrode layer 72 of piezoelectric element 70. Therefore, resistor R1 and constant voltage source +V=5 are unnecessary and omitted. A signal from electrode layer 72 is applied to trigger generator 28.

When free end 24T of coil spring 24 is deviated with respect to string 3 upon plucking of string 3, free end 24T of coil spring 24 abuts against piezoelectric element 70, and a polarization electromotive force corresponding to a string plucking force or a shock is generated. The electromotive force is supplied to operational amplifier OP1 of touch level detector 29 through resistors R2 and R3, and is output as touch response signal Tch representing the plucking force. The signal corresponding to the polarization electromotive force is also supplied to trigger generator 28, and is output as tone trigger signal Tr indicating start of tone generation.

In this embodiment, since piezoelectric element 70 is formed around string 3, touch response data TD can be obtained even if string 3 is vibrated in any direction, e.g., the vertical, horizontal, and oblique directions. String trigger switch TSW and touch level switch TchSW commonly use piezoelectric element 70. Therefore, the structure can be simplified.

[Eleventh Embodiment (FIG. 34)]

Figure 34:
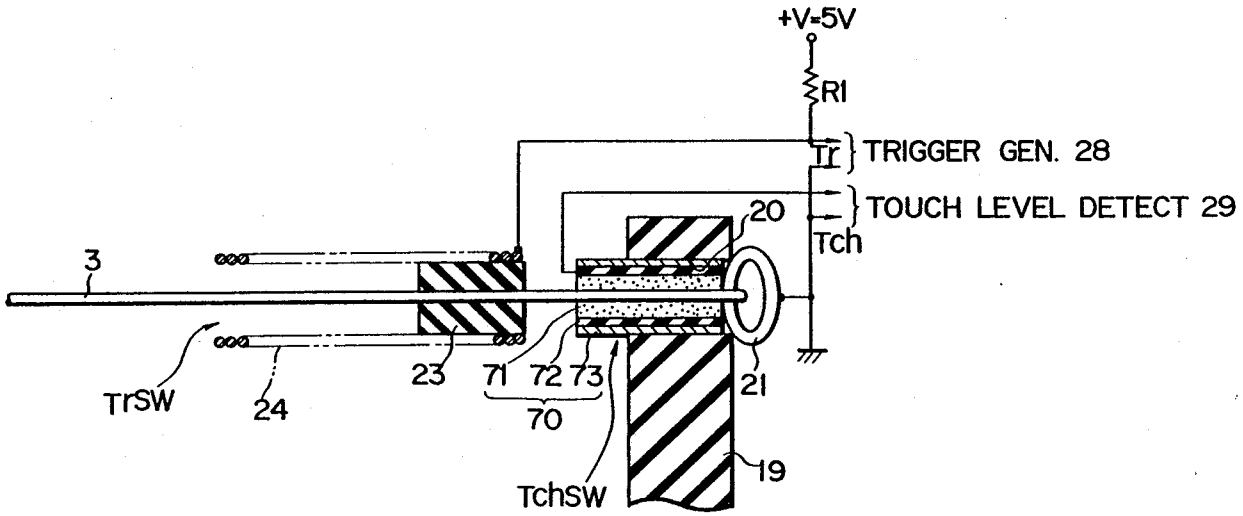
FIG. 34 is a longitudinal sectional view of touch level switch TchSW and string trigger switch TSW in an 11th embodiment.

FIG. 34 shows the structure of string trigger switch TSW and touch level switch TchSW according to an eleventh embodiment of the present invention. In this embodiment, piezoelectric element 70 is not arranged in coil spring 24 unlike in FIG. 32. More specifically, the inner diameter of through hole 20 in string holding portion 19 is increased, and piezoelectric element 70 is housed therein. A signal from electrode layer 72 of piezoelectric element 70 with respect to grounded string 3 is sent to touch level detector 29. A signal from coil spring 24 with respect to grounded string 3 is sent to trigger generator 28 in the same manner as in the fourth embodiment. A constant voltage is supplied from constant voltage source+V=5 to coil spring 24 through resistor R1.

When string 3 is plucked and urges piezoelectric film member 71 of piezoelectric element 70, a polarization electromotive force corresponding to a plucking force or a shock is generated in piezoelectric film member 71, and is supplied to operational amplifier OP1 of touch level detector 29 through resistors R2 and R3. Then, the electromotive force is output from amplifier OP1 as touch response signal Tch representing the plucking force.

In this embodiment, touch response data TD is determined by only movement of string 3 instead of by a relative movement between string 3 and coil spring 24. Therefore, a sensitivity of a touch response signal can be easily adjusted.

[12th Embodiment (FIG. 35)]

Figure 35:
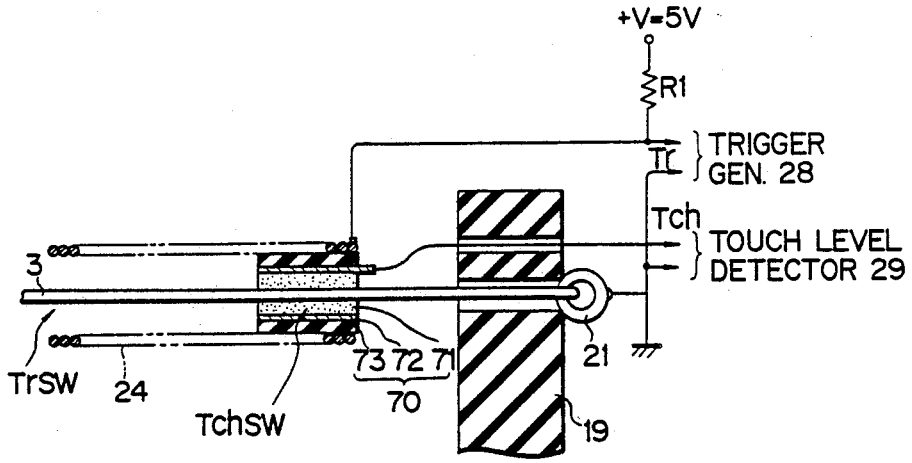
FIG. 35 is a longitudinal sectional view of touch level switch TchSW and string trigger switch TSW in a 12th embodiment.

FIG. 35 shows the structure of string trigger switch TSW and touch level switch TchSW according to a 12th embodiment of the present invention. In this embodiment, insulating member 23 shown in FIG. 32 is replaced with piezoelectric element 70. Wiring connections to touch level detector 29 and trigger generator 28 are the same as those in the eleventh embodiment. In this embodiment, touch response data TD indicating the plucking force can be obtained by a pressure or a shock of string 3 against piezoelectric film member 71 as in the eleventh embodiment.

In this embodiment, since piezoelectric element 70 serves as a member for supporting coil spring 24, insulating member 23 for supporting coil spring 24 is omitted.

[13th Embodiment (FIG. 36)]

Figure 36:
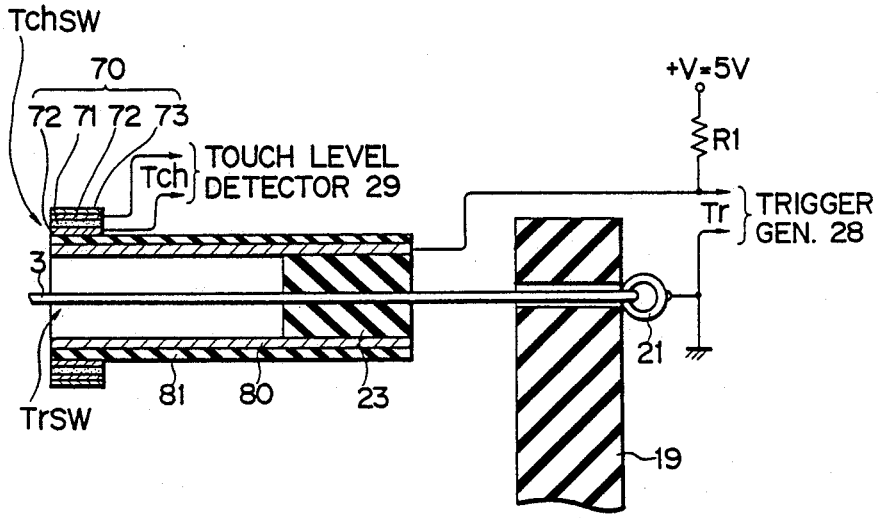
FIG. 36 is a longitudinal sectional view of touch level switch TchSW and string trigger switch TSW in a 13th embodiment.

FIG. 36 shows the structure of string trigger switch TSW and touch level switch TchSW according to a 13th embodiment of the present invention. In this embodiment, the base portion of cylindrical conductive tube 80 having a flexibility is fitted on insulating member 23 in place of coil spring 24. Insulating tube 81 having a flexibility is laminated on the entire outer surface of conductive tube 80. Constant voltage +V=5 is applied to conductive tube 80 through resistor R1, and a signal from conductive tube 80 with respect to grounded string 3 is sent to trigger generator 28.

Annular piezoelectric element 70 is fitted on the distal end of insulating tube 81. In piezoelectric element 70, electrode layer 72, piezoelectric film member 71, electrode layer 72, and insulating film 73 are laminated in this order from the inside. These electrode layers 72 are respectively connected to the noninverting and inverting terminals of operational amplifier OP1 through resistors R2 and R3.

If the distal ends of conductive and insulating tubes 80 and 81 abut against string 3 upon plucking of string 3, a polarization electromotive force corresponding to a plucking force or a shock is generated in piezoelectric film member 71, and is output as touch response signal Tch representing the plucking force through the touch level detector.

In this embodiment, since the outer surface of conductive tube 80 is insulated by insulating tube 81, tone trigger signal Tr cannot be erroneously generated beside plucking of strings.

Note that piezoelectric element 70 can be arranged on the inner surface of conductive tube 80 through insulating film 73 instead of on the outer surface of insulating tube 81.

In the above-mentioned sixth embodiment and 10th to 13th embodiments, a magnetic strain element such as nickel can be used in place of piezoelectric element 70, and the same effect as described above can also be obtained.

As an element for obtaining touch response data TD corresponding to plucking of string 3, the distance between electrodes of a capacitor is changed or the position of a magnetic core in a coil is moved upon a very small deviation, the deviation can be converted to a change in capacitance or inductance, or a change in resistance due to extension/contraction of a resistor wire can be utilized. The present invention is not limited to the above embodiments.

What is claimed is:

1. An electronic stringed instrument, comprising:

an instrument main body;

at least one string member extended at a predetermined position on said instrument main body, said string member being arranged to be deviated against a tension upon a string displace operation to be brought into a tense state from a rest state, and said string member being released from the tense state to a release state upon a string release operation thereafter;

string trigger switch means including a first conductive member and a second conductive member coupled to said string member, for generating a tone generation start instruction signal by bringing said first and said second conductive members into an electrically conductive state when said string member is displaced from the tense state to the release state by said string release operation; and musical tone generating start instruction means coupled to said string trigger switch means for starting generation of a musical tone at a time when the tone generation start instruction signal is outputted.

2. An electronic stringed instrument according to claim 1, wherein said first conductive member includes a conductive contact member coupled to said string member, and said second conductive member includes a conductive elastic member arranged around said conductive contact member, and an electrically insulating member is provided between said conductive elastic member and said conductive contact member, said string trigger switch means being arranged so that while said string member is displaced in a direction away from its rest state, said conductive elastic member and said conductive contact member are displaced in the same direction as the displaced direction of said string member while maintaining a predetermined gap between the conductive elastic member and the conductive contact member so as to maintain a switch-off state, and when said string member is released from its tense state, said conductive elastic member and said conductive contact member are in electrical contact with each other to establish a switch-on state.

3. An electronic stringed instrument according to claim 1, comprising:

pitch designating signal outputting means for outputting a pitch designating signal corresponding to a predetermined depressed position of said instrument main body in correspondence with said string member; and musical tone generating start instruction means, coupled to said string trigger switch means, for starting generation of a musical tone at a pitch designated by said pitch designating means in accordance with the tone generation start instruction signal from said string trigger switch means.

4. An electronic stringed instrument according to claim 3, wherein said first conductive member includes a conductive contact member coupled to said string member, and said second conductive member includes a conductive elastic member arranged around said conductive contact member, and an electrically insulating member is provided between said conductive elastic member and said conductive contact member, said string trigger switch means being arranged so that while said string member is displaced in a direction away from its rest state, said conductive elastic member and said conductive contact member are displaced in the same direction as the displaced direction of said string member while maintaining a predetermined gap between the conductive elastic member and the conductive contact member so as to maintain a switch-off state, and when said string member is released from its tense state, said conductive elastic member and said conductive contact member are in electrical contact with each other to establish a switch-on state.

5. An electronic stringed instrument according to claim 4, wherein said string member consists of a conductive material, and is molded integrally with said conductive contact member.

6. An electronic string instrument according to claim 4, wherein said string member comprises a synthetic resin material, and is detachably coupled to said conductive contact member.

7. An elecrtronic stringed instrument according to claim 4, wherein said insulating member is adhered to said conductive contact member, and one end of said conductive elastic member is adhered to said insulating member, so that the other end thereof maintains a gap with respect to said conductive contact member in a normal state and is in electrical contact with said conductive contact member upon the string release operation.

8. An electronic stringed instrument according to claim 4, wherein said insulating member includes a first insulating member and a second insulating member adhered to said conductive contact member, said first insulating member and said second insulating member maintain a predetermined distance, and said conductive elastic member is arranged to extend between said first insulating member and said second insulating member, so that said conductive elastic member maintains a predetermined gap from said conductive contact member at a central portion between said first and said second insulating members in the rest state and is in electrical contact with said conductive contact member upon entering the string release operation.

9. An electronic stringed instrument according to claim 4, wherein said conductive elastic member comprises any one of a coil spring-like conductor and a tubular conductor having flexibility.

10. An electronic stringed instrument according to claim 4, wherein one end of said conductive contact member is coupled to one end of said string member and the other end of said conductive contact member is pivotally supported on said instrument main body.

11. An electronic stringed instrument according to claim 4, wherein one end of said conductive contact member is coupled to one end of said string member and the other end of said conductive contact member is supported for swiveling movement by a semispherical fixing member on said instrument main body.

12. An electronic stringed instrument according to claim 10, wherein one end of said conductive contact member is coupled to one end of said string member and the other end of said conductive contact member is supported on said instrument main body to pivot about an axial support member fixed to said instrument main body.

13. An electronic stringed instrument according to claim 4, wherein said conductive elastic member and said insulating member are coupled to an end portion of said conductive contact member, and a central portion of said conductive contact member is supported on said instrument main body to pivot about an axial support member fixed to said instrument main body.

14. An electronic stringed instrument according to claim 3, wherein said instrument main body has a body portion and a neck portion, said string trigger switch means is arranged on said body portion of said instrument main body, and said pitch designating means is arranged on said neck portion of said instrument main body.

15. An electronic stringed instrument according to claim 3, wherein said instrument main body has a body portion and a neck portion, said string trigger switch means and said string member are arranged on said body portion.

16. An electronic stringed instrument according to claim 3, wherein said instrument main body has a body portion and a neck portion, said string trigger switch means is arranged on said body portion, said pitch designating means is arranged on said neck portion, and said string member is extended over said body portion and said neck portion.

17. An electronic stringed instrument according to claim 3, comprising:

touch response detecting means, arranged on said instrument main body to be coupled to said string member, for detecting a string-vibration strength of said string member; and musical tone control means for controlling characteristics of a musical tone to be generated ion accordance with the string-vibration strength of said string member detected by said touch response detecting means.

18. An electronic stringed instrument according to claim 17, wherein said first conductive member includes a conductive contact member coupled to said string member, and said second conductive member includes a conductive elastic member arranged around said conductive contact member, and an elecrtrically insulating member is provided between said conductive elastic member and said conductive contact member, said string trigger switch means being arranged so that while said string member is displaced in a direction away from its rest state, said conductive elastic member and said conductive contact member maintain a predetermined gap between the conductive elastic member and the conductive contact member so as to maintain a switch-off state, and when said string member is released from its tense state, said conductive elastic member and said conductive contact member are in electrical contact with each other to establish a switch-on state.

19. An electronic stringed instrument according to claim 17, wherein said touch response detecting means comprises plucking force detecting means, coupled to said string member, for detecting a plucking force in response to the string release operation, and touch level detecting means for detecting a peak value of plucking force data in accordance with the plucking force detected by said plucking force detecting means.

20. An electronic string instrument according to claim 19, wherein said touch level detecting means comprises touch response signal outputting means for outputting a touch response signal corresponding to the plucking force detected by said plucking force detecting means, and analog-to-digital conversion means for converting the touch response signal output from said outputting means into a digital signal.

21. An electronic stringed instrument according to claim 17, wherein said musical tone control means comprises storage means for temporarily storing a peak value of a string-vibration strength signal in accordance with the string-vibration strength detected by said detecting means, and characteristic control means for controlling characteristics of a musical tone to be generated in accordance with the peak value of the string-vibration strength signal in response to the tone generation start instruction signal output from said string trigger switch means.

22. An electronic stringed instrument according to claim 17, whereby said touch response detecting means is detachably coupled to said string member.

23. An electronic stringed instrument according to claim 19, wherein said plucking force detecting means comprises a magnet fixed to said string member, and a conductive magnetic member which is fixed to said string member through an insulating member so as to be magnetically coupled to said magnet and generates an induced electromotive force corresponding to a deviation of said string member upon the string release operation.

24. An electronic stringed instrument according to claim 23, wherein said string member consists of a conductive material, and said conductive magnetic member is formed in a cylindrical shape having first and second end portions, said first end portion being fixed on said insulating member, and said second end portion being a free end facing said magnet.

25. An electronic stringed instrument according to claim 19, wherein said plucking force detecting means comprises conductive response string means coupled to said string member for displacement with said string member, a pair of support members fixed to said conductive response string member with a predetermined separation between the support members, a flexible tube extended between said support members, and magnet means, fixed to the interior of said tube, for generating in the conductive response string means an induced electromotive force corresponding to an extent of deviation of said string member from said rest state to said tense state, when a relative deviation occurs between said conductive response string means and said magnet means.

26. An electronic stringed instrument according to claim 19, wherein said plucking force detecting means comprises a rod-like conductor coupled to said string member to form a first electrode, a piezoelectric film formed on an outer surface of said rod-like conductor, an electrode layer formed on said piezoelectric film to form a second electrode, and a shock adding member arranged around said rod-like conductor, said shock adding member adding shock against said electrode layer, when the string release operation of said string member occurs.

27. An electronic stringed instrument according to claim 26, wherein said electrode layer is electrically coupled to said touch level detecting means.

28. An electronic stringed instrument according to claim 26, wherein said string member and said rod-like conductor are integrally molded with a conductive material.

29. An electronic stringed instrument according to claim 26, wherein a shock protective film is formed on said electrode layer so as to protect said electrode layer and said piezoelectric film.

30. An electronic stringed instrument according to claim 26, wherein said shock adding member comprises any one of a coil-like wire member and a cylindrical member.

31. An electronic stringed instrument according to claim 26, wherein two ends of each said shock adding member are supported by a pair of support members fixed to said rod-like conductor with a predetermined interval, said piezoelectric film and said electrode layer being formed on said rod-like conductor between said pair of support members.

32. An electronic stringed instrument according to claim 30, wherein one end of said shock adding member is supported by a support member fixed to said rod-like conductor.

33. An electronic stringed instrument according to claim 19, wherein said plucking force detecting means comprises magnetic detecting means, coupled to one end of said string member, for magnetically detecting a deviation of said string member in a longitudinal direction thereof and generating an induced electromotive force corresponding to the deviation.

34. An electronic stringed instrument according to claim 33, wherein said magnetic detecting means comprises a coil bobbin having one end coupled to an end portion of said string member and around which a response coil is wound, a yoke and a magnet arranged to have a predetermined gap with respect to said coil bobbin, and a spring having one end coupled to the other end of said coil bobbin and the other end coupled to said instrument main body.

35. An electronic stringed instrument according to claim 33, wherein said magnetic detecting means comprises a magnet fixed to said string member, a coil bobbin which is arranged around said magnet to have a predetermined magnetic gap therefrom and around which a response coil is wound, and a spring having one end is coupled to an end portion of said string member and the other end coupled to said instrument main body.

36. An electronic stringed instrument according to claim 33, wherein said plucking force detecting means comprises a pressure sensitive element which is coupled to a support member for fixing an end portion of said string member to said instrument main body.

37. An electronic stringed instrument according to claim 36, wherein said string member comprises a conductive material to constitute a first electrode, said pressure sensitive element comprises a piezoelectric film formed on an outer surface of said string member electrode, and an electrode layer is formed on an outer surface of said piezoelectric film to constitute a second electrode.

38. An electronic stringed instrument according to claim 18, wherein said touch response detecting means is embedded in said insulating member.

39. An electronic stringed instrument according to claim 38, wherein said touch response detecting means comprises a piezoelectric film formed on an outer surface of said string member to constitute a first electrode, and an electrode layer arranged between said piezoelectric film and said insulating member to constitute a second electrode.

40. An electronic stringed instrument according to claim 18, wherein said touch response detecting means is arranged on a portion of said conductive elastic member, which is in electrical contact with said conductive contact member.

41. An electronic stringed instrument according to claim 40, wherein said touch response detecting means comprises first and second electrode layers, and a piezoelectric film arranged between said electrode layers.

42. An electronic stringed instrument according to claim 1, further comprising musical tone generating means for generating a predetermined musical tone in accordance with an instruction signal from said musical tone generating start instruction means.

43. An instrument according to claim 42, wherein said musical tone generation means is arranged in said instrument main body.

44. An electronic stringed instrument according to claim 3, further comprising musical tone generating means for generating a predetermined musical tone in accordance with an instruction signal from said musical tone generating start instruction means.

45. An electronic stringed instrument according to claim 44, wherein said musical tone generation means is arranged in said instrument main body.

46. An electronic stringed instrument according to claim 17, further comprising musical tone generating means for generating a predetermined musical tone in accordance with an instruction signal from said musical tone generating start instruction means.

47. An electronic stringed instrument according to claim 46, wherein said musical tone generation means is arranged in said instrument main body.

* * * * *

UNITED STATES PATENT AND TRADEMARK OFFICE

CERTIFICATE OF CORRECTION

PATENT NO. : 4,911,053

DATED : March 27, 1990

INVENTOR(S) : KASHIO et al

It is certified that error appears in the above-identified patent and that said Letters Patent is hereby corrected as shown below:

Title page - item [73] Assignee: Change "Casio Computer" to --Casio Computer Co., Ltd.--.

Signed and Sealed this

Twenty-fourth Day of August, 1993

Bruce Lehman

*Attest:*

BRUCE LEHMAN

*Attesting Officer*

*Commissioner of Patents and Trademarks*